United States Patent [19]

Rivoire

[11] Patent Number: 4,584,798

[45] Date of Patent: Apr. 29, 1986

[54] AUTOMATED RAILWAY TRACK MAINTENANCE SYSTEM

[75] Inventor: Albert Rivoire, North Syracuse, N.Y.

[73] Assignee: Speno Rail Services Co., East Syracuse, N.Y.

[21] Appl. No.: 594,546

[22] Filed: Mar. 29, 1984

[51] Int. Cl.[4] ..... B24B 23/00; G06F 15/46

[52] U.S. Cl. ..... 51/178; 51/165.71; 364/474

[58] Field of Search ..... 51/178, 165.71; 364/474, 117, 118

[56] References Cited

U.S. PATENT DOCUMENTS

| | | | |
|---|---|---|---|
| 2,779,141 | 1/1957 | Speno, Jr. et al. | 51/178 |
| 3,358,406 | 12/1967 | Speno Jr. et al. | 51/178 |
| 3,606,705 | 9/1971 | Rivoire | 51/178 |
| 3,807,098 | 4/1974 | Schaller et al. | 51/165.71 |
| 4,074,468 | 2/1978 | Panetti | 51/178 |
| 4,100,700 | 7/1978 | Peirce et al. | 51/92 R |
| 4,115,857 | 9/1978 | Panetti | 51/178 |
| 4,178,724 | 12/1979 | Bruno | 51/178 |
| 4,205,494 | 6/1980 | Rivoire | 51/178 |
| 4,248,019 | 2/1981 | Hawley et al. | 51/45 |
| 4,347,688 | 9/1982 | Scheuchzer et al. | 51/178 |
| 4,365,918 | 12/1982 | Theurer | 51/178 |

FOREIGN PATENT DOCUMENTS 1152746 8/1983 Canada .

*Primary Examiner*—Roscoe V. Parker

*Attorney, Agent, or Firm*—Norbert P. Holler

[57] ABSTRACT

A railway track maintenance system for grinding the heads of rail track rails. The system includes a master microprocessor which controls a plurality of individual slave microprocessors controlling a plurality of grinding heads positioned under a series of railway vehicles. The grinding heads are individually adjustable in angular position and grinding pressure. The pattern of the grinding heads can be changed sequentially while the train is moving at grinding speed. The grinding heads can also be sequentially lifted and then lowered to grinding position for obstacle clearance while the train is moving at grinding speed.

35 Claims, 24 Drawing Figures

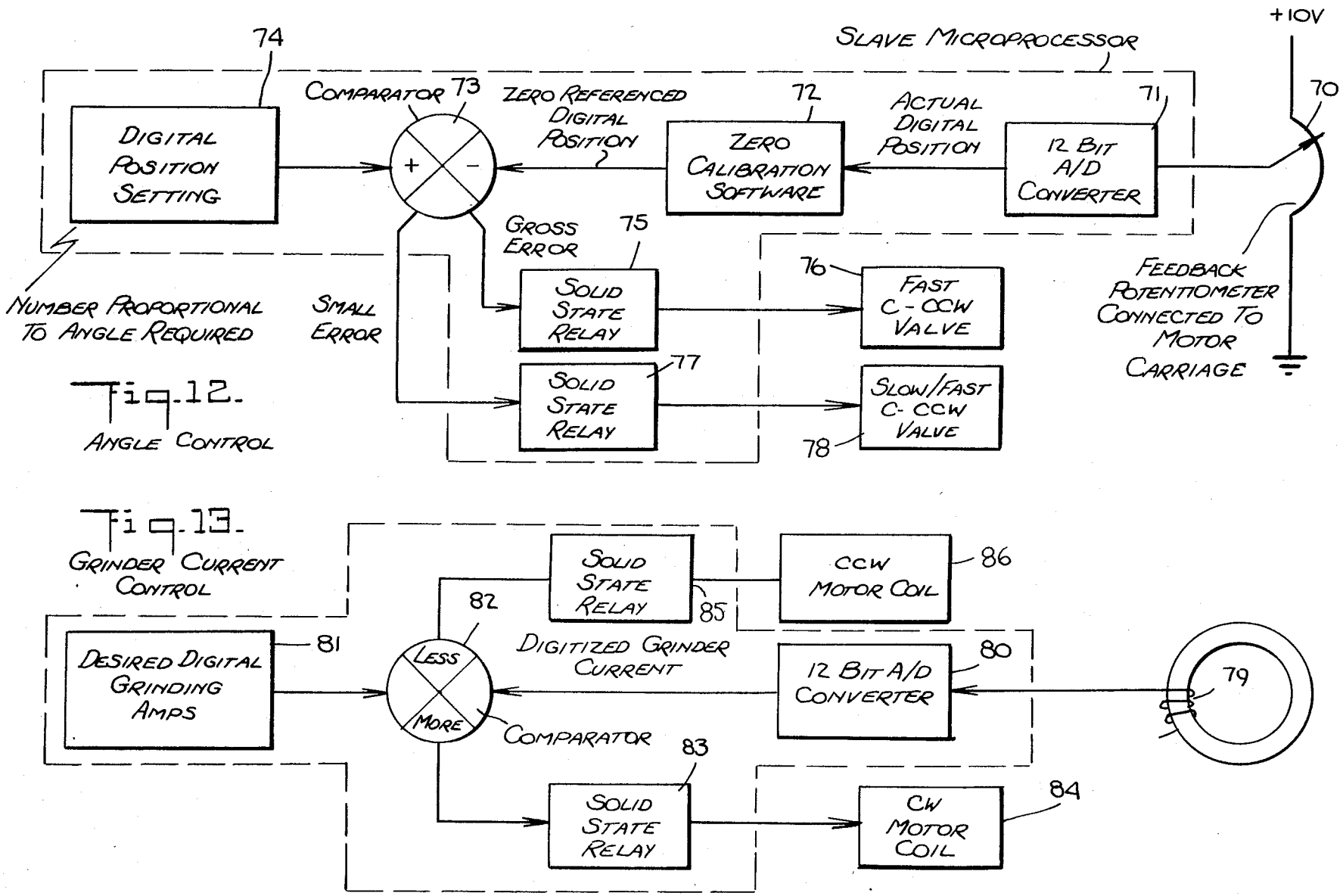
Fig. 12. ANGLE CONTROL
Fig. 13. GRINDER CURRENT CONTROL

OBSTACLE CLEARANCE

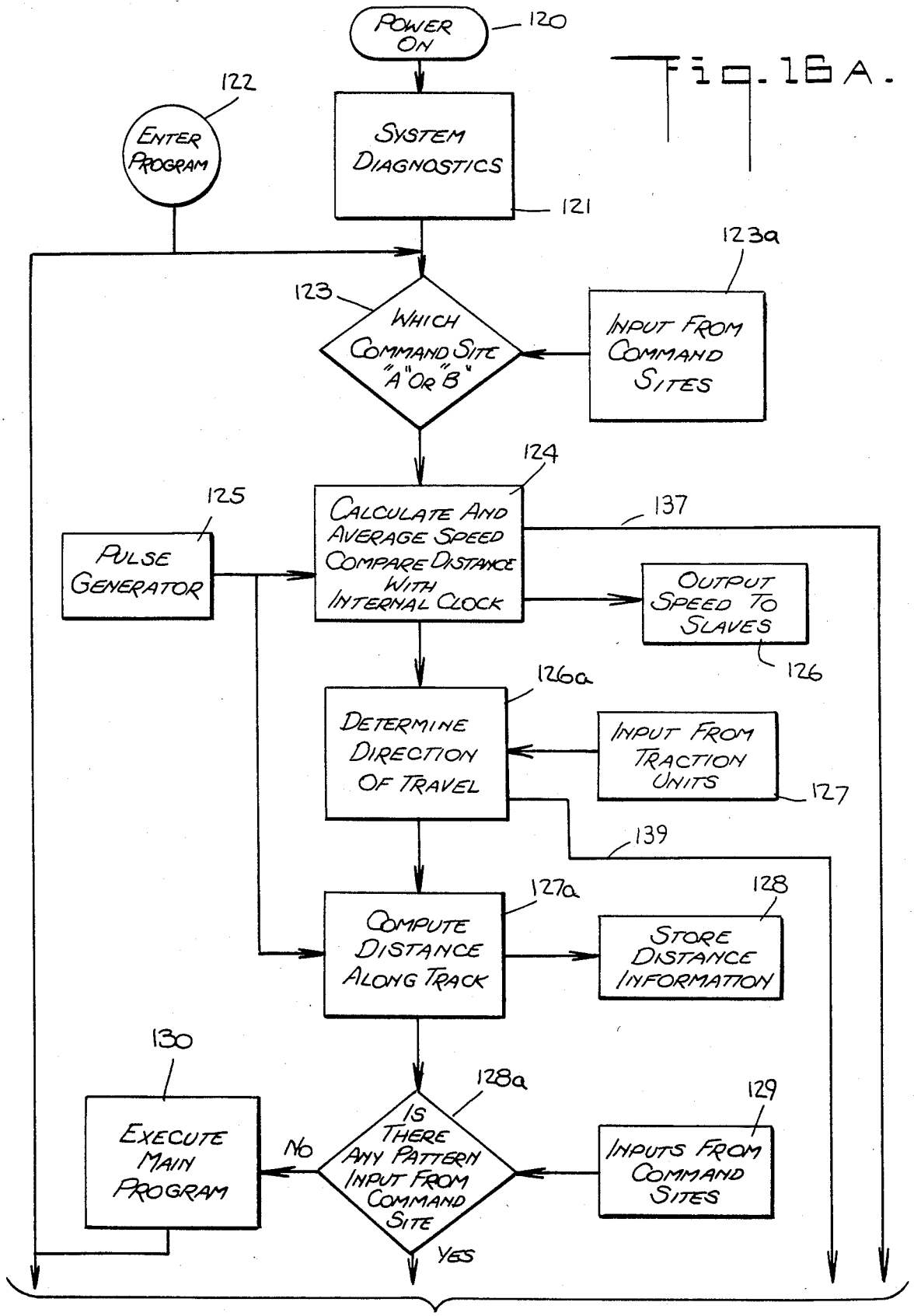
TO FIG. 16 B.

AUTOMATED RAILWAY TRACK MAINTENANCE SYSTEM

This invention relates to an automated railway track maintainance system for grinding the head of railway track rails.

A prior railway track maintenance machine is described in Canadian Pat. No. 1,152,746 which describes a railway vehicle having at least one slipper carrying at least two grinding units, that is, rotary cutting tools. The grinding units can be adjustably positioned angularly and transversely of the rail head and can be adjusted for grinding pressure.

However, the patent does not suggest an automated railway track maintenance system suitable for use for automatically controlling a plurality of rail head grinding means positioned under a plurality of railway vehicles.

It is an object of the present invention to provide a new and improved automated railway track maintenance system which avoids one or more of the limitations and disadvantages of prior railway track maintenance systems.

It is another object of the invention to provide a new and improved automated railway track maintenance system which can be actuated by an operator in the leading vehicle of a series of vehicles for controlling the grinding means under the series of vehicles.

It is another object of the invention to provide a new and improved automated railway track maintenance system capable of automatically controlling the grinding means in accordance with predetermined pattern codes as selected by a program or an operator.

It is another object of the invention to provide a new and improved automated railway track maintenance system in which the grinding pattern of the grinding means can automatically be changed while a series of vehicles driving the grinding means is moving at a grinding speed.

It is another object of the invention to provide a new and improved automated railway track maintenance system in which can be actuated by an operator in a leading vehicle when he locates an obstacle along the rails for sequentially raising the grinding means under a series of vehicles at approximately the same position along the rails before the obstacle and while the series of vehicles is moving at a grinding speed.

It is another object of the invention to provide a new and improved automated railway track maintenance system which can be actuated by an operator who has located an obstacle's terminal or distant end for lowering the grinding means sequentially under the series of vehicles at approximately the same position along the railway track rails after the obstacle has been cleared by each vehicle and its corresponding grinding means.

In accordance with the invention, an automated railway track maintenance system for grinding the head of railway track rails comprises rail head grinding means adapted for positioning under at least one railway vehicle. The system also includes master signal processor control means at least parially adapted for actuation by an operator in the leading vehicle of a series of railway vehicles for controlling the grinding means. The system also includes slave signal processor control means responsive to the master signal processor control means for controlling the grinding means in accordance with commands from the master signal processor control means.

For a better understanding of the present invention, together with other and further objects characteristics and advantages thereof, reference is made to the following description, taken in connection with the accompanying drawings and its scope will be pointed out in the appended claims.

FIG. 12 is a schematic diagram of a portion of the railway track maintenance system constructed in accordance with the invention for controlling the angle of the grinding means;

FIG. 13 is a schematic diagram of a portion of the railway track maintenance system for controlling the grinder current of individual grinders;

FIGS. 16A, 16B and 16C are a flow chart representing a portion of the master microprocessor which operates according to a computer program produced according to the flow chart;

Figure 1:
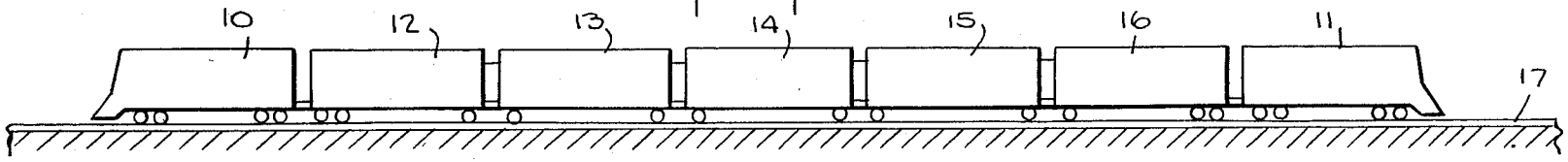
FIG. 1 is a schematic drawing of a series of railway vehicles including vehicles under which and in which an automated railway track maintenance system constructed in accordance with the invention is mounted.

Before referring to the drawings, it will be understood that for purposes of clarity, the system represented in the block diagrams utilizes, for example, a master microprocessor and slave microprocessors which include such hardware as a central processing unit, program and random access memories, timing and control circuitry, input-output interface devices and other conventional digital sub-systems necessary to the operation of the central processing unit as is well understood by those skilled in the art. The master and slave microprocessors operate according to the computer programs produced according to the flow charts represented in the drawings.

Referring now more particularly to FIG. 1 of the drawings, there is represented a series of railway vehicles in which and under which the railway track maintenance system constructed in accordance with the invention is positioned. The series of vehicles preferably includes locomotives 10, 11, for driving grinding cars 12, 13, 14, 15, 16 in either direction along railway rails 17.

Figure 2:
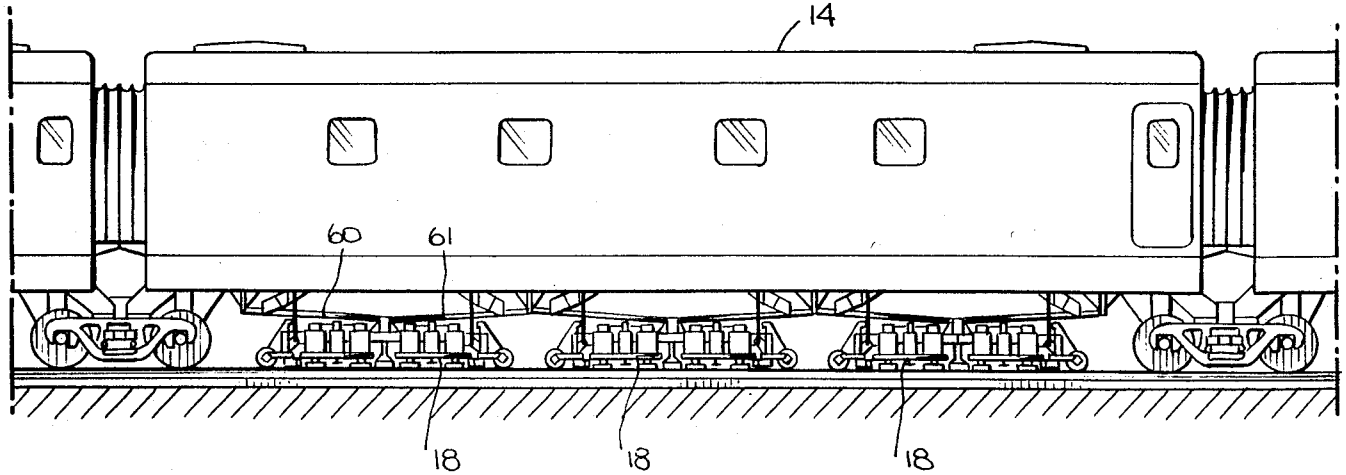
FIG. 2 is a side elevational view of a railway vehicle of FIG. 1, to an enlarged scale, under which a group of buggies constituting a portion of the railway track maintenance system is mounted.
Figure 3:
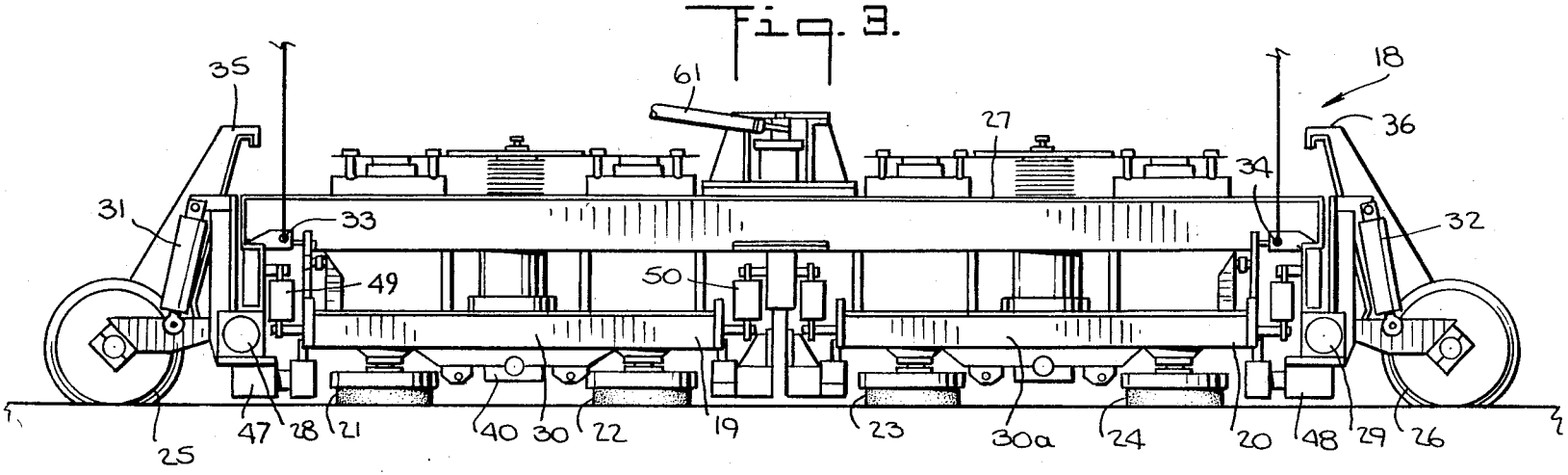
FIG. 3 is a side elevational view, to an enlarged scale, of a buggy of the FIG. 2 drawing with two grinding units appearing therein in the work position.

Referring now more particularly to FIG. 2 of the drawings, there is represented grinding car 14 under which there are positioned buggies 18 of similar construction. As represented in FIG. 3, each buggy 18 preferably carries four grinding units, only two of which can be seen in FIG. 3, and each grinding unit 19, 20 preferably includes two grinders 21, 22 or 23, 24. There preferably are three buggies under each of five railway vehicles, thereby providing sixty grinders on each railway rail.

Figure 4:
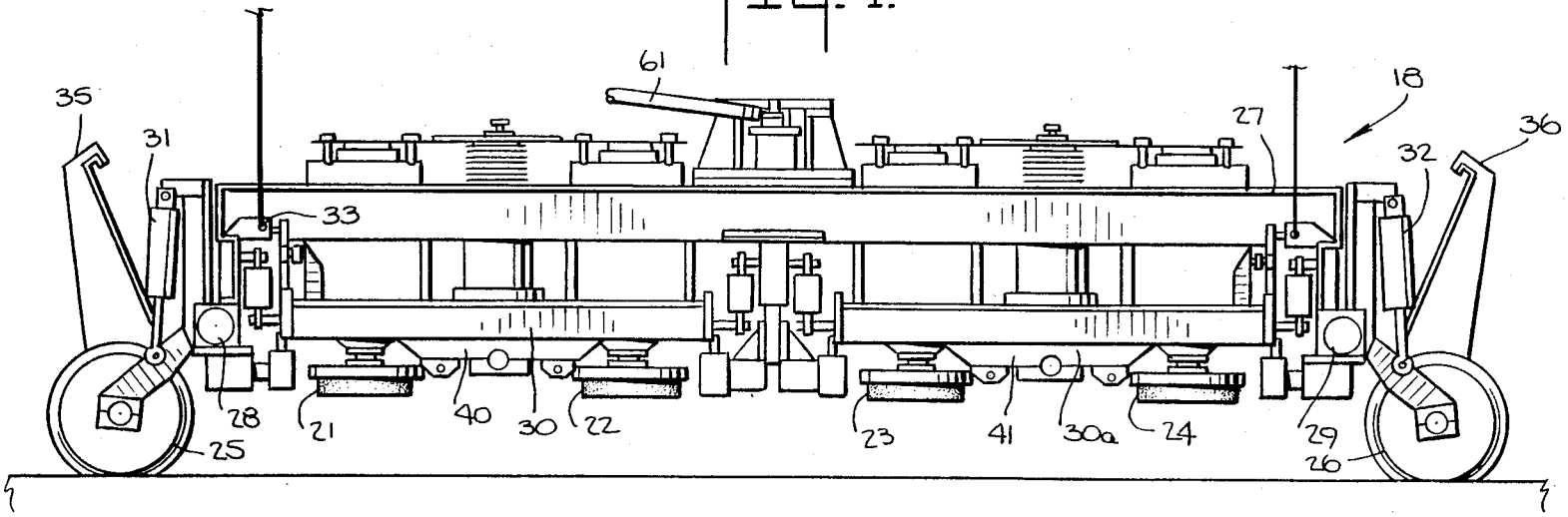
FIG. 4 is a side elevational view, to an enlarged scale, of the FIG. 3 buggy with the grinding units in the raised or lifted position.
Figure 5:
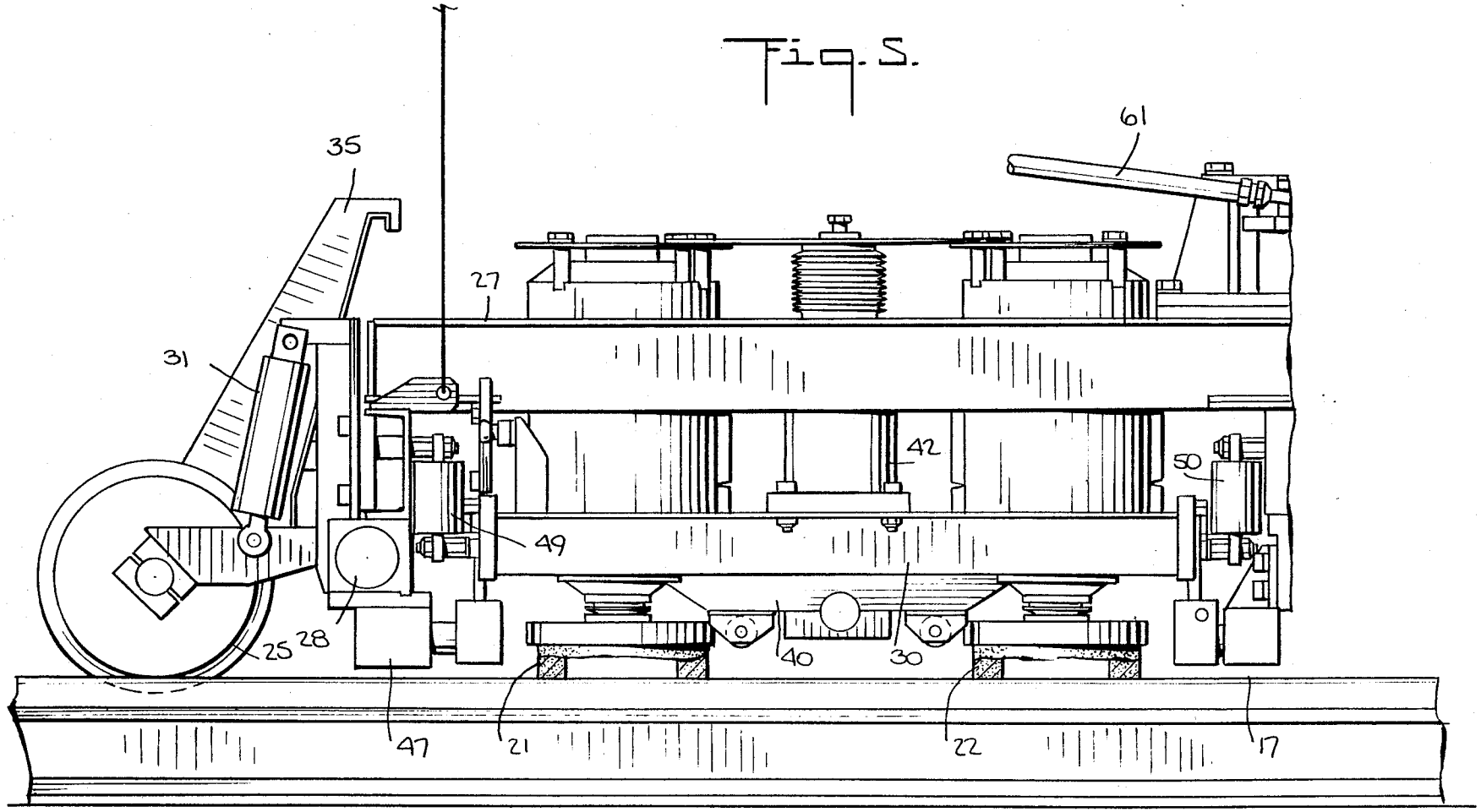
FIG. 5 is a side elevational view of a portion of the FIG. 3 buggy, to an enlarged scale, with one of the grinding units shown in fragmentary view in a work position.
Figure 6:
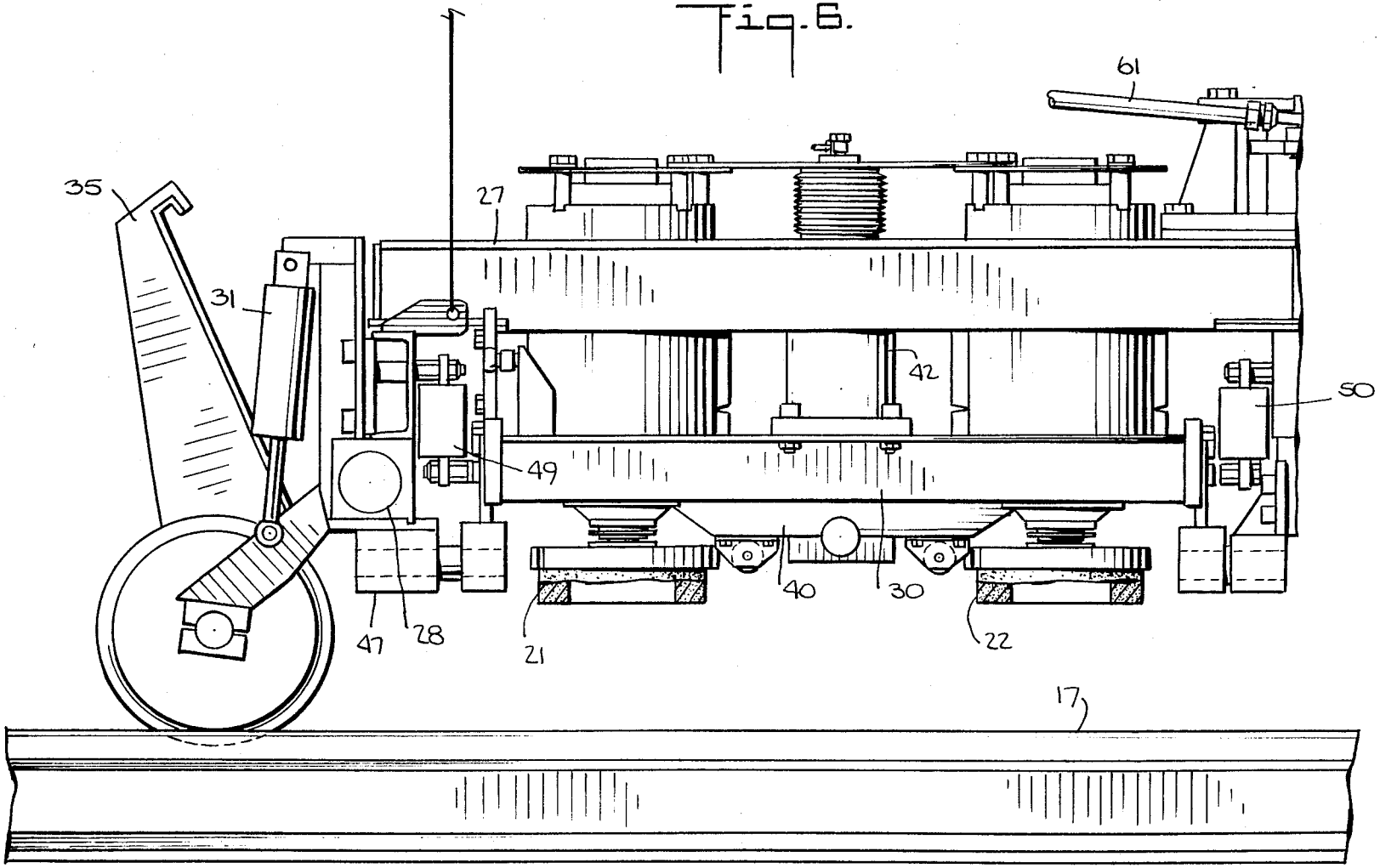
FIG. 6 is a side elevational view of the FIG. 4 buggy, to an enlarged scale, showing one of the grinding units in a lifted or raised position.

The buggy 18 has a pair of wheels 25, 26 riding on one railway rail and another pair of wheels not shown in FIG. 3 riding on the other railway rail. The buggy has a first or main frame 27 having integral therewith shafts 28, 29 about each of which a second frame 30, 30*a* can pivot upon expansion of cylinders 31, 32 for lifting the second frames 30, 30*a* and the grinders 21, 22, and 23, 24 into an obstacle clearance position as represented in FIG. 4. As represented in FIG. 5, the main frame 27 and the second frame 30 are in the work position with disk grinders 21, 22 in contact with rail 17. As represented in FIG. 6 when cylinders 31, 32 are expanded, the main frame 27 is lifted, raising the grinding disks 21, 22, into an obstacle clearance position which may, for example, be several feet above the rail.

From the foregoing description, it will be understood that the grinding units of the buggy move from the obstacle clearance position to the grinding position by actuation of four obstacle clearance cylinders 31, 32 and two additional cylinders (not shown) on each corner of the buggy. Hydraulic pressure is applied to a hydraulic pumping and valve system, causing cylinders 31, 32 and the two additional cylinders (not shown) to retract and lower the grinding units to the rail 17 by a pivoting action about the shafts 28, 29. The grinding units are raised into the obstacle clearance position by extension of the cylinders 31, 32 and the two additional cylinders (not shown) on each corner of the buggy.

The same cylinders 31, 32 and two additional cylinders (not shown) on each corner of the buggy are used for carrying the buggy 16 on the railway vehicle above it. A hydraulic cylinder (not shown) mounted on the vehicle and actuating a rotational lift shaft by means of retracting its rod, which in turn retracts rotationally four cables attached at four corners of the buggy through, for example, apertures 33, 34 and two additional apertures (not shown), thereby lifting the buggy from the obstacle clearance position into a prepare for travel position with the entire buggy including its wheels above the track rails.

When the buggy has been so lifted, the cylinders 31, 32 and the two additional cylinders (not shown) on each corner of the buggy are retracted, moving locking arms 35, 36 into engagement with a support frame on the railway vehicle above the buggy. A limit switch gives indication that the locking arms are in the correct position. The lifting cylinder (not shown) is then extended allowing the buggy to lower into the support frame, engaging the hooks on arms 35, 36 in the support frame. A limit switch indicates the correct locked travel position.

The buggy is put into the obstacle clearance and grinding positions by reversing the steps just mentioned.

Figure 7:
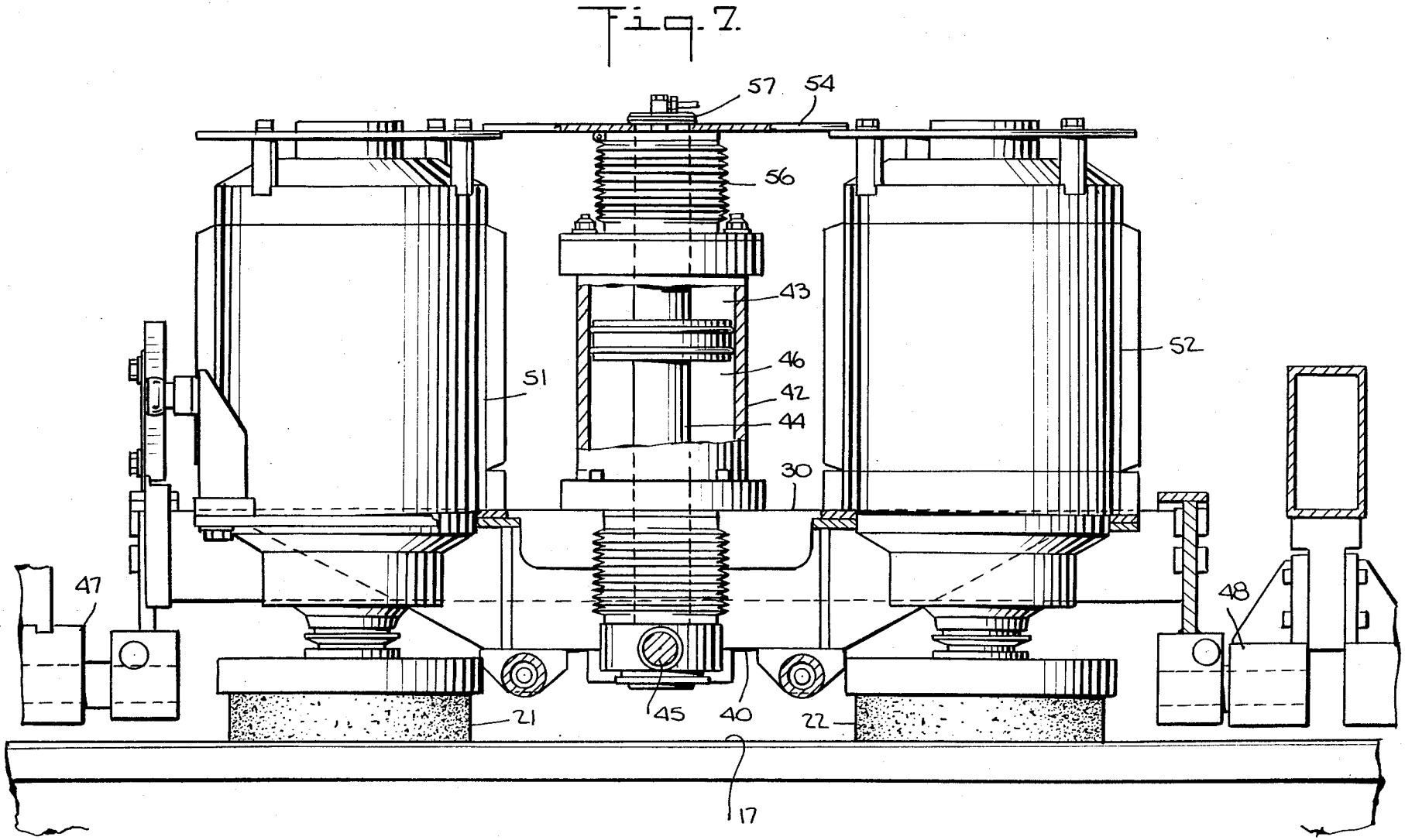
FIG. 7 is a side elevational view, to an enlarged scale, of the FIG. 5 grinding units with a portion of a pneumatic cylinder parially broken away.

Referring now more particularly to FIGS. 6 and 7, the grinding head motor frame 40 is kept raised from the rail 17, as represented in FIG. 6, when the grinding unit is in the obstacle clearance position by applying a fixed pneumatic pressure on side 43 of the grinding double-ended rod cylinder 42. The rod 44 of the cylinder 42 is fixed to the frame 40 which is capable of pivoting about bearing 45 in a direction longitudinally of the rail 17 under operating conditions to be described more fully hereinafter. The grinding heads 21, 22 can be forced to the work position represented in FIG. 7 by applying a regulated air pressure to the end 46 of the cylinder 42, thereby raising the cylinder 42 and the frame 30.

Referring again to FIGS. 3 and 7, the frame 30 which supports the motor head frame 40 may be pivoted about bearings 47, 48 which extend longitudinally to the rail, thus changing the planar positions of the grinding disks 21, 22 transversely up to 90° about the rail. Pivoting is accomplished by extending cylinders 49, 50 which may be seen in FIGS. 3 and 6.

Figure 8:
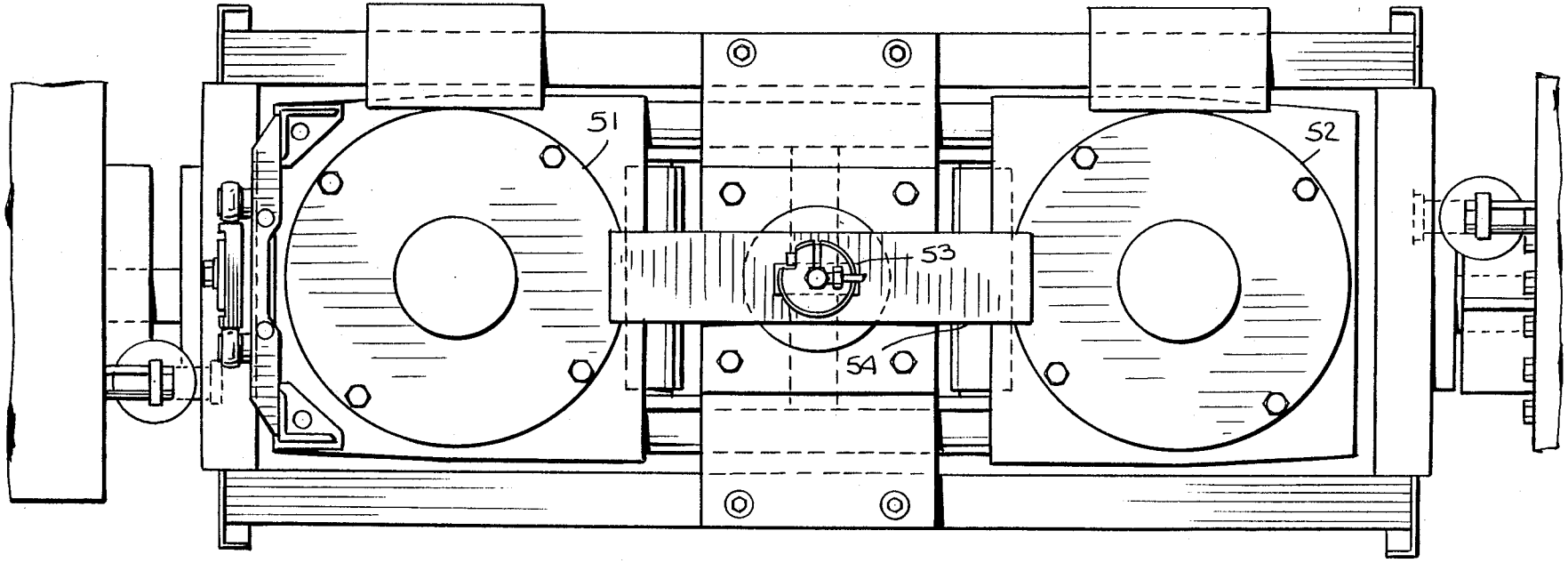
FIG. 8 is a top plan of the FIG. 7 grinding unit.

Referring now to FIG. 7, the motor head frame 40 supporting the grinder motors 51, 52 may be pivoted about bearing 45 to adjust for differential abrasive grinding disk wear of grinding disks 21, 22. Referring also to FIG. 8, the pivoting of the frame 40 about the bearing 45 is restricted by a slot 53 in frame 54 which links the motors 51, 52 together. A spring/hydraulic clamping device 56 of conventional construction maintains a clamping plate 57 on a clamping piston (not shown) pressed against the bar 54, thereby clamping the clamping plate 57 against the bar 54 and against the piston rod 44 of the cylinder 46. If differential wear of the grinding disks 21, 22 occurs, the automatic control system senses a motor load differential between the pair of motors 51, 52 and pulses the hydraulic locking device 57 which serves as a long wave clamping device to allow an equi-load condition to prevail. When the hydraulic locking device is pulsed, the clamping plate 57 is unclamped during the pulsing interval, allowing the motors 51, 52 to adjust their position angularly longitudinally of the rail.

As represented in FIGS. 2 and 3, the grinding buggy is moved along the rails under its corresponding vehicle by a drawbar arrangement 60, 61.

Figure 9:
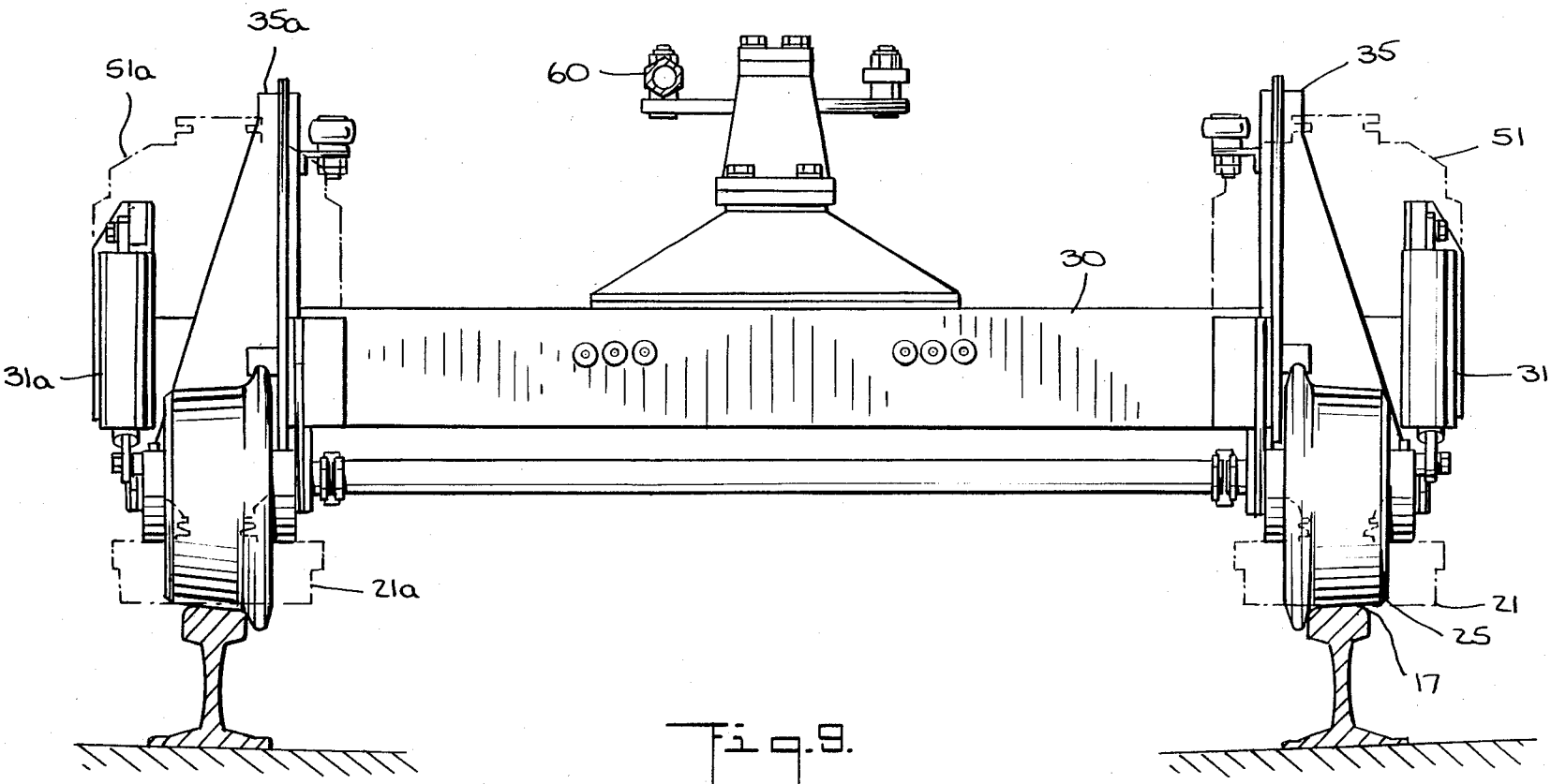
FIG. 9 is a front elevational view, to an enlarged scale, of a portion of the FIG. 3 buggy.

Referring now more particularly to FIG. 9, there is represented a front elevational view of a portion of the grinding buggy with cylinder 31 and a corresponding cylinder 31*a* being represented. Grinding motors 51 and 51*a* and grinding disks 21 and 21*a* are represented in broken line construction.

Figure 10:
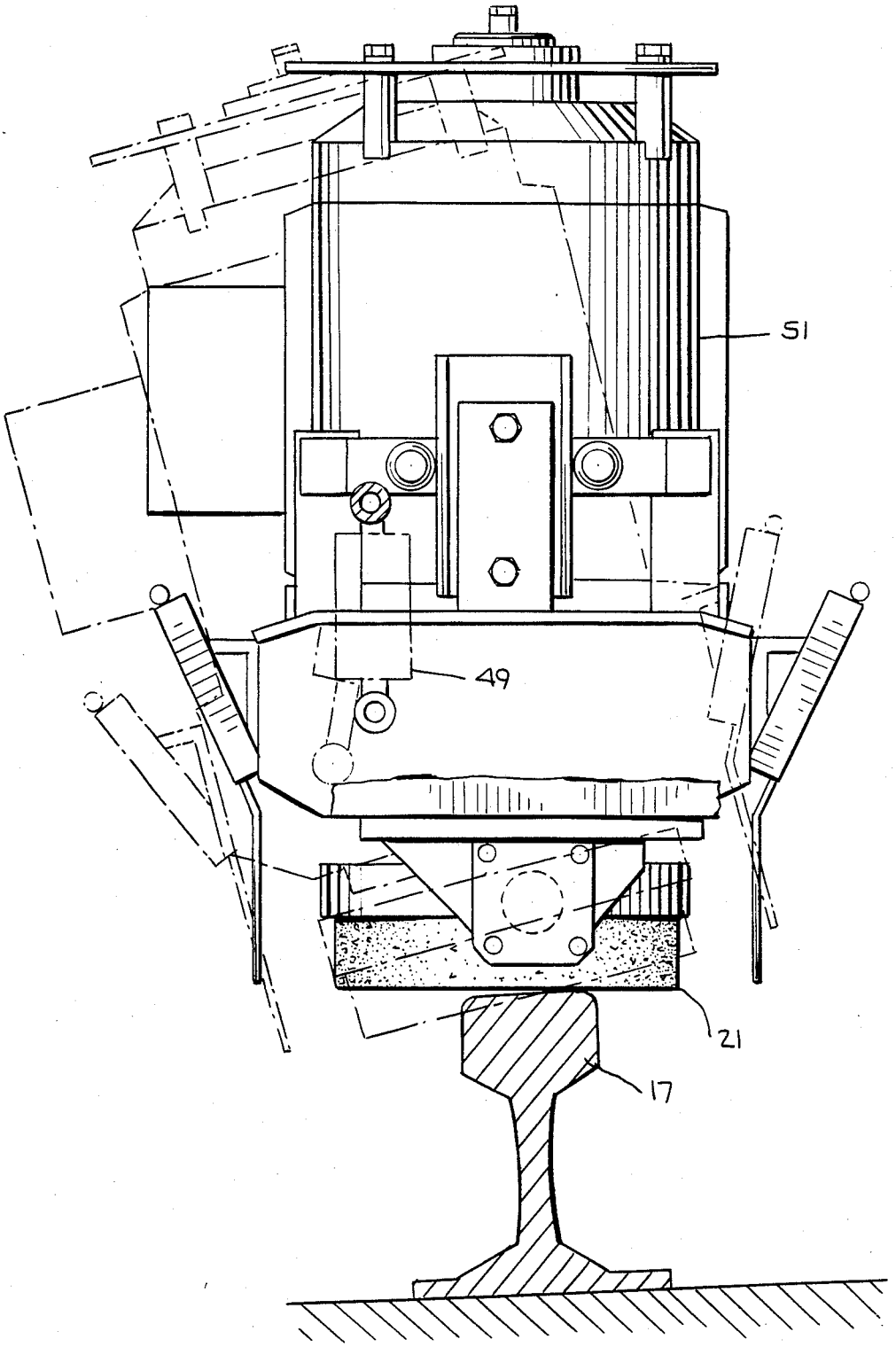
FIG. 10 is a front elevational view, to an enlarged scale, of one of the grinding of the FIG. 3 buggy.

As represented in FIG. 10, grinding is initated by lowering the grinding units into the grinding position with the application of pressure to the side 43 of the cylinder 42 of FIG. 7 and sequentially starting the grinder motors in a time delayed sequence preferably to commence grinding at approximately the same absolute position along the rails while the vehicles are moving. Cessation of grinding is accomplished by releasing pressure from side 43 of cylinder 42. If an obstacle, for example, switches, road crossings or the like, is encountered, in addition to cessation of grinding, the obstacle clearance cylinders 31, 32 of FIG. 3 are extended to lift the unit into the obstacle clearance position.

As represented in FIG. 10, the grinding unit can be rotated transversely of the rail 17 upon expansion of the cylinder 49.

As mentioned previously in connection with FIG. 8, a long wave grinding effect is accomplished by the arrangement of two grinding heads in a fixed frame with, for example, approximately 26 inch motor shaft centers. In effect, this makes a fixed grinding unit approximately 36 inches long with four grinding surfaces on each rail. The normal use of an individual grinding head with, for example, a ten inch diameter grinding disk allows the individual head to follow waves or defects in the rail of a wavelength longer than ten inches. The two head fixed arrangement, presenting four grinding surfaces in one plane, reduces by a large degree the following effect of the grinding heads, depending on the wavelengths encountered.

Figure 11A:
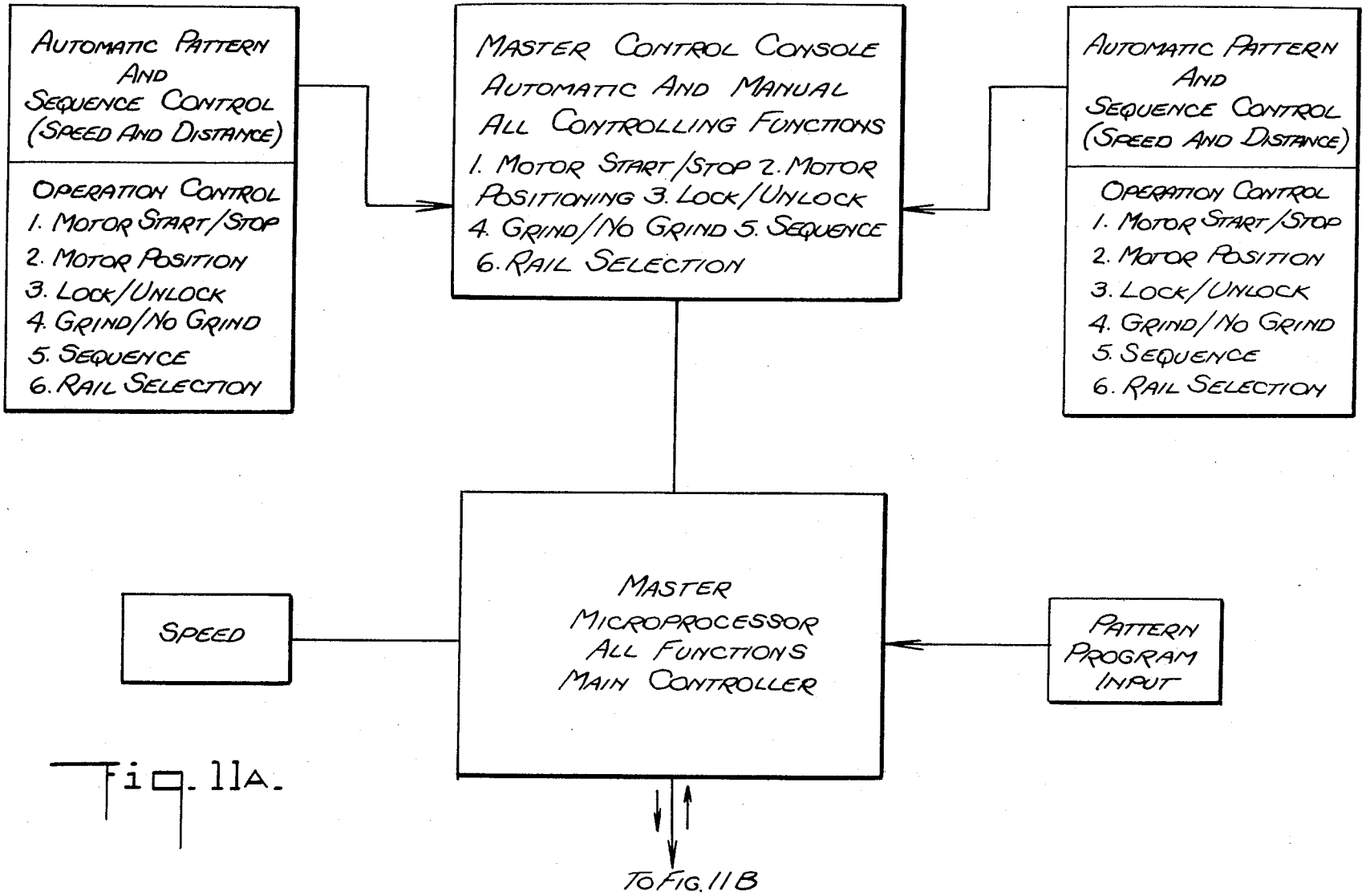
FIGS. 11A and 11B are a schematic diagram of a railway track maintenance system constructed in accordance with the invention.
Figure 11B:
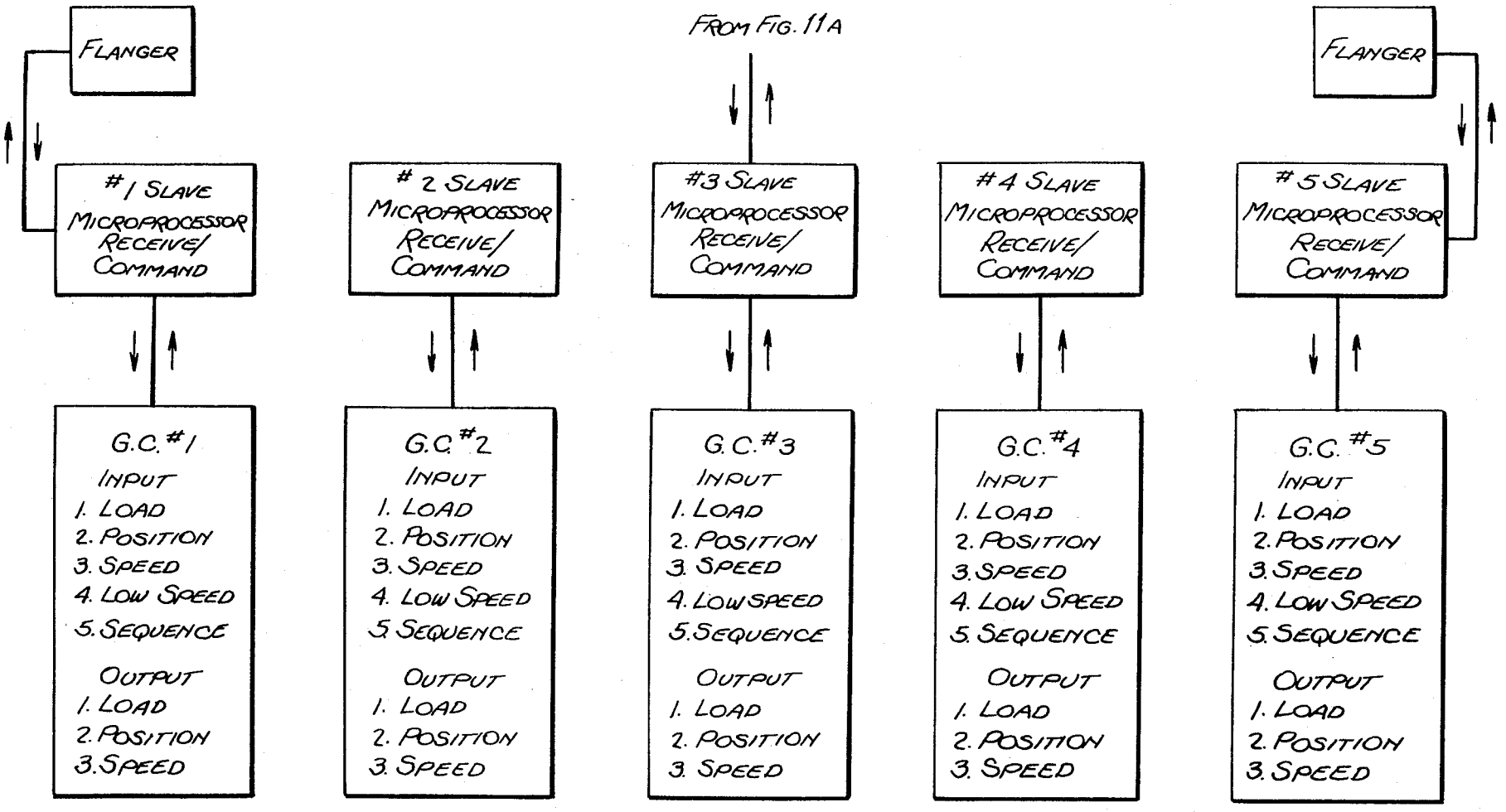

Referring now more particularly to FIG. 11 (illustrated in divided form as FIGS. 11A and 11B), there is represented a master and slave microprocessor control system which is explained by the designations of each block of the diagram. It will be understood that an operator at each locomotive of the series of vehicles can apply inputs to the master control console manually and additionally an operator at the master control console can apply inputs manually. The term motor position refers to a motor position in a specific pattern, the term lock/unlock refers to operation in the travel mode and the term sequence refers to obstacle clearance control. In addition, the designation G. C. represents an abbreviation for grinding car. Also it will be understood that ordinarily there would be included cathode ray tube displays and digital displays of the various operations such as load, position and speed and also digital displays of the selected set points for the grinders and the buggy condition and the motor condition. These have not been represented in the drawing of FIG. 11 for the purpose of clarity.

In accordance with the automated railway track maintenance system of the invention, railway tracks are resurfaced by a train riding slowly along the tracks at a speed of, for example, two to four miles per hour. The grinding operation is accomplished by grinders which are positioned around the periphery of the rail by hydraulic cylinders and which are caused to move against the rail by air over air cylinders. Both the angular position of the grinders and the grinding force are controlled by a closed loop system. In addition, the grinding force and the angular settings of each grinder are automatic in that the operator of the system can select the angle and grinding pressures for all, for example, 120 grinding motors through the use of preassigned codes. Each code specifies the grinding angle and grinding pressure of each grinder along the train. In addition, the operator at the center console can adjust the pressure and angle of each grinder independently.

As the grinding train moves along the tracks, it also has the capabidty of lifting grinders in sequence as they near obstacles along the tracks. The initiation of the sequencing, as well as the reset of the sequencing, is accomplished by the operator of the train as he nears the obstacle. Once an obstacle is entered into memory it is remembered for a distance of, for example, one mile in either direction. In other words, if the train has passed the obstacle it can turn around and go back in the opposite direction without. having to reenter the obstacle. One computer acts as a master computer and is located at the center console in the middle grinding car. There is also a slave computer for each grinding car which controls the actual operation of the grinders and angle positioners.

Each pair of grinders is angularly positioned by two hydraulic cylinders. Fluid flow to the hydraulic cylinders is controlled by hydraulic valves located in the grinding cars. Each pair of cylinders is controlled by two hydraulic valves. One hydraulic valve controls the slow movement of the cylinders both clockwise and counterclockwise and a second hydraulic valve, which is turned on in addition to the slow valve, controls high speed motion counterclockwise and clockwise. A 10 volt power supply and a potentiometer supply the feedback signal which determines the actual position of the grinder. A microprocessor control together with solid state relays act as the output interface to the 120 volt AC control valves. A 12 bit analog to digital converter converts the 0 to 10 volt signal from the potentiometer into a digital signal which is used to control the valves.

When the train is put into service the operators of the train use a machinist's level to level the grinding stones at zero degrees. Once all of the grinding stones on one car are placed at the zero degree angle a switch is thrown which automatically tells the computer what the offset voltage is for each grinder motor. The computer uses this offset voltage in making all its angular moves.

As represented in FIG. 12, a feedback potentiometer 70 connected to the motor carriage feeds a signal representing the angular position of the grinding stone to a 12 bit analog to digital converter 71. Since the converter is a 12 bit analog to digital converter, a 10 volt signal would give an accuracy of one part in 204. Once the calibrations done, represented by the zero calibration software 72 in FIG. 12, depending on the total angular travel which the grinder will make, a volts per degree ratio is determined and a zero referenced digital position signal is applied to a comparator 73. When the operator or the automatic program enters a desired angle represented by a digital position setting 74, which may be a repeater of digital position setting in the master microprocessor, the angle is converted to volts and eventually digitized into counts as represented by the digital position setting 74. The computer then turns on the high speed motion in the proper direction until the grinder is within five counts of the actual position. This is done by means of a solid state relay 75 and a fast clockwise-counterclockwise valve 76. Once the grinder has neared the actual position by five counts, that is, once the error is less than five counts, the high speed solenoid valve is switched off and the grinder continues to travel at the slow speed. This is accomplished by the solid state relay 77 and the slow/fast clockwise-counterclockwise valve 78. The grinder will continue to travel at slow speed until it has an error of less than one count. At this point, the low speed solenoid valve 78 turns off and the grinder is in position. This is a closed loop positioning system where the potentiometer provides an actual count and the program provides a desired count. Motion continues until the desired count equals the actual count and the system then shuts down. Actual speed of motion is determined by the flow controls on the hydraulic circuit. Each pair of grinders throughout the train is controlled in a similar way.

Actual grinding pressure which determines how much metal will be removed from the rail is controlled in a closed system by using an air over air pneumatic cylinder to provide the force and a current transformer sensing grinding motor current to provide the feedback. The air over air cylinder 42 is represented in FIG. 7. The air over air cylinder 42 is controlled by a rotary valve with a two way A.C. motor which is used to open and close the valve. When the valve is turned counterclockwise, the down pressure decreases and the opposing pressure lifts the grinder from the rail. When the valve is turned clockwise, the grinder is pushed down against the rail.

Referring now to FIG. 13, a current transformer 79 which converts grinding current into voltage is coupled with one leg of the grinding motor. Similar current transformers are individually coupled with the legs of all the grinding motors. The current transformer 79 senses the grinding current and through a 12 bit analog to digital converter 80 sends back a zero to five volt signal representative of the grinding current. The actual grinding current loop operates as follows. Either the operator or the computer enters the desired grinding pressure, as represented by unit 81 of FIG. 13, which may be a repeater of a desired digital grinding amperes portion of the master microprocessor. The desired grinding pressure is converted into counts in the portion 81 and applied to a comparator 82 which compares the counts with the counts applied thereto by the analog to digital converter 80. Depending on whether the desired digital grinding amperes counts are greater or less than the counts being fed back through the current transformer, a rotating motor opens or closes the air valves to increase or decrease the grinding pressure. The pressure is either increased or decreased until the actual counts coming back from the current transformer voltage circuits are equal to the desired counts which have been entered by the operator or by the preprogrammed grinding routines. Once these two signals are equal, the valve is turned off and is held at this position. If the counts of the desired digital amperes are more than the counts of the digitized grinder currents, the comparator 82 energizes the solid state relay 83 which energizes the clockwise motor coil 84 to increase the grinding pressure. If the desired grinding ampere counts are less than the counts of the digitized grinder current, the comparator 82 energizes the solid state relay 85 which energizes the counterclockwise motor coil to decrease the grinding pressure.

Referring for the moment to FIG. 2, each group of eight grinders comprising four pairs is mounted on a buggy 18. The buggy is suspended from beneath its associated vehicle (here the vehicle 14) by cables and rides on its own wheels along the railway tracks. Using a set of cylinders mounted on each of the corners, clearance of an obstacle is accomplished by moving the cylinders in such a manner that they press down against the wheel linkage and lift the main frame of the grinding buggy into the air as represented in FIG. 4. Once the grinding units are clear of the obstacle, that is, when the vehicle has passed the obstacle, the cylinders are turned off and the reverse action brings the grinding units into the position represented in FIG. 3 with the grinders down on the rail. The operator in the leading locomotive visually checks for obstacles along the rails and when he encounters an obstacle presses a button in the locomotive when the obstacle is visually sighted at a predetermined distance from the cab of the locomotive. The same button can enter the end of the obstacle when it is in the operator's sight.

Figure 14:
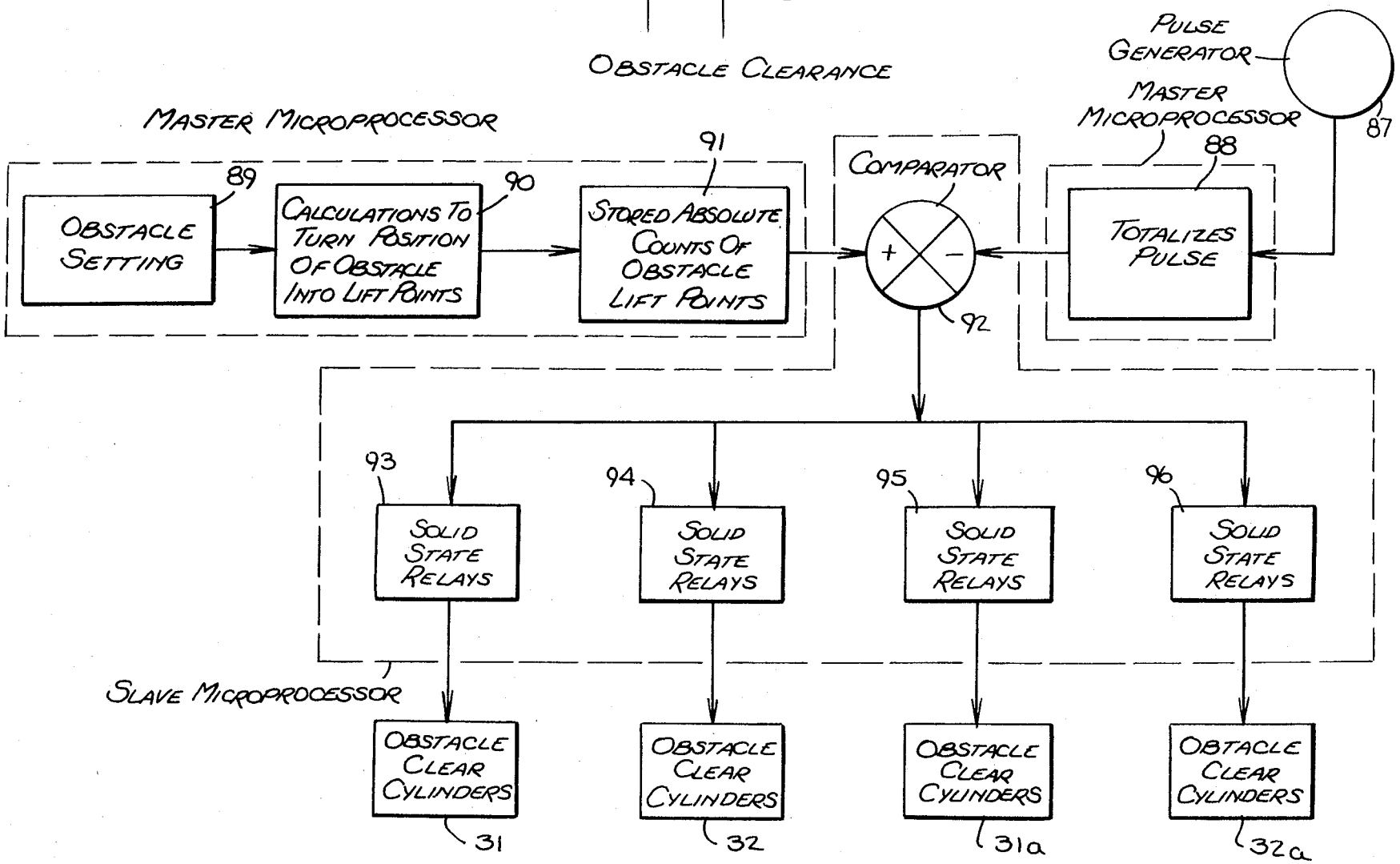
FIG. 14 is a schematic diagram of a portion of the railway track maintenance system for controlling obstacle clearance of the grinding units.

Referring now to FIG. 14, a pulse generator 87 located on the axle of the leading locomotive provides a series of pulses, for example, one pulse for every 2.09 inches traveled, which the computer uses to determine the actual distance traveled. These pulses are totalized in the master microprocessor as represented by the block 88 of the diagram of FIG. 14.

Each grinder on the train has had its distance from the front of the train tabulated into the memory of the computer, and so once an obstacle is entered by the operator, the computer automatically counts pulses from the point of entry to each grinder and raises and lowers the grinder in turn. In addition, the computer has the memory capacity to store actual starting and stopping points of multiple obstacles and to remember them for a distance of, for example, one mile. The obstacle memory can be cleared and initiated in the opposite direction when the direction of movement of the train is reversed. Additionally, the system can stop while in the sequence of operation and reverse, performing the obstacle clearance sequence in reverse order.

As represented in FIG. 14, the operator enters an obstacle setting in a portion 89 of the master microprocessor, which has a portion 90 which performs calculations to convert the obstacle positions into lift points and has a memory 91 which stores absolute counts of the obstacle lift points. A comparator 92 compares the stored absolute counts with the pulse count representing distance applied thereto by the master microprocessor portion 88 and when the counts are equal or if the stored absolute count of an obstacle lift point is less than the totalized pulse count, the comparator 92 develops an output signal which is applied to solid state relays 93, 94, 95, 96 to energize the obstacle clearance cylinders **31, 32, 31*a*, 32*a*** to lift the main frame of the buggy at the lift point or within inches thereof so that the grinding disks clear the obstacle.

Figure 18:
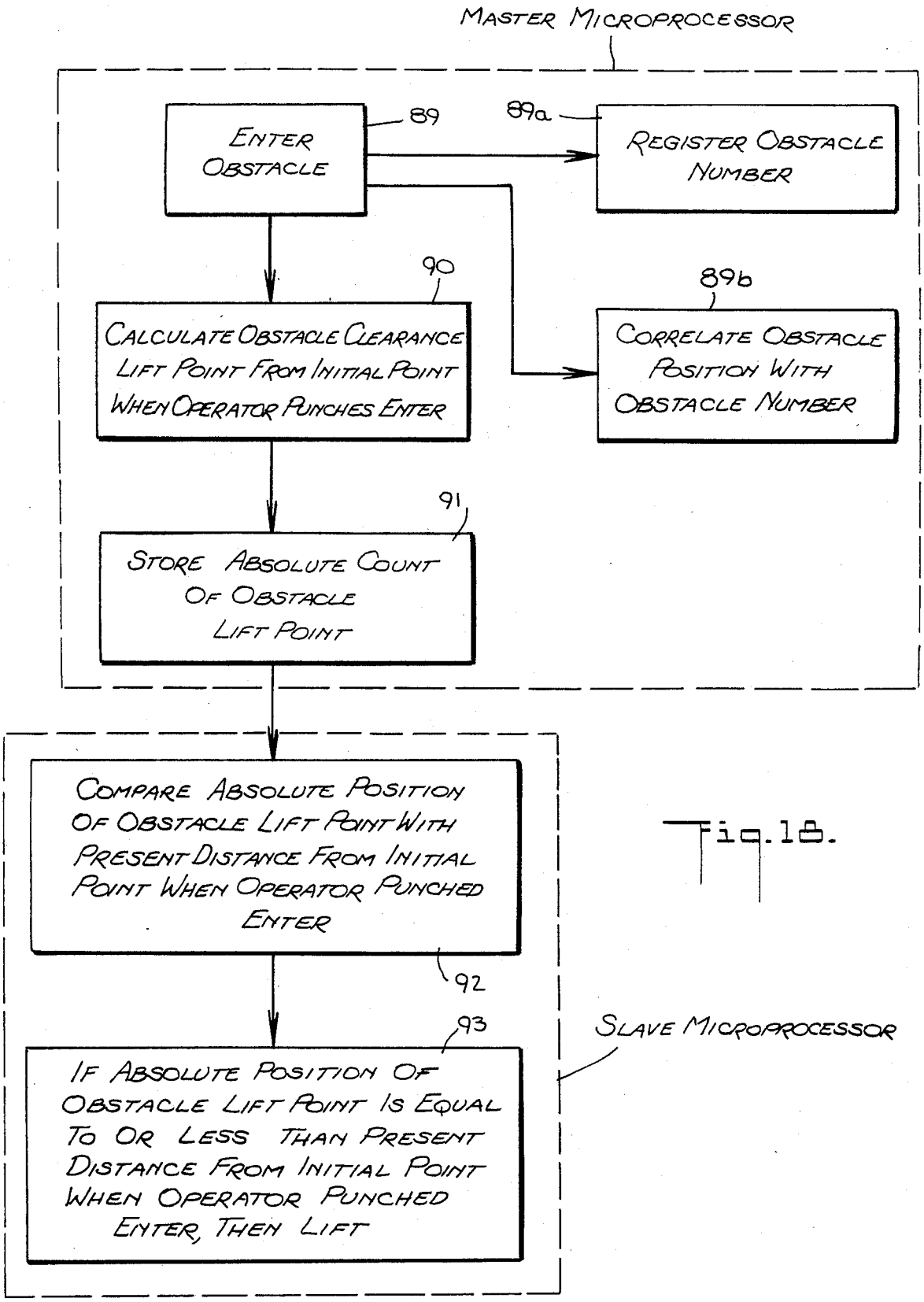
FIG. 18 is a flow chart representing a portion of the master microprocessor and a portion of a slave microprocessor which operate according to a computer program produced according to the flow chart.

The obstacle clearance lift flow chart is repeated in slightly different language in FIG. 18 in which the same reference numerals are used for the same portions of the microprocessors of FIG. 14. Additionally, FIG. 18 represents a register obstacle number represented by portion **89*a* of the master microprocessor and a correlate obstacle position with obstacle number represented by portion 89*b*** of the master microprocessor.

Figure 19:
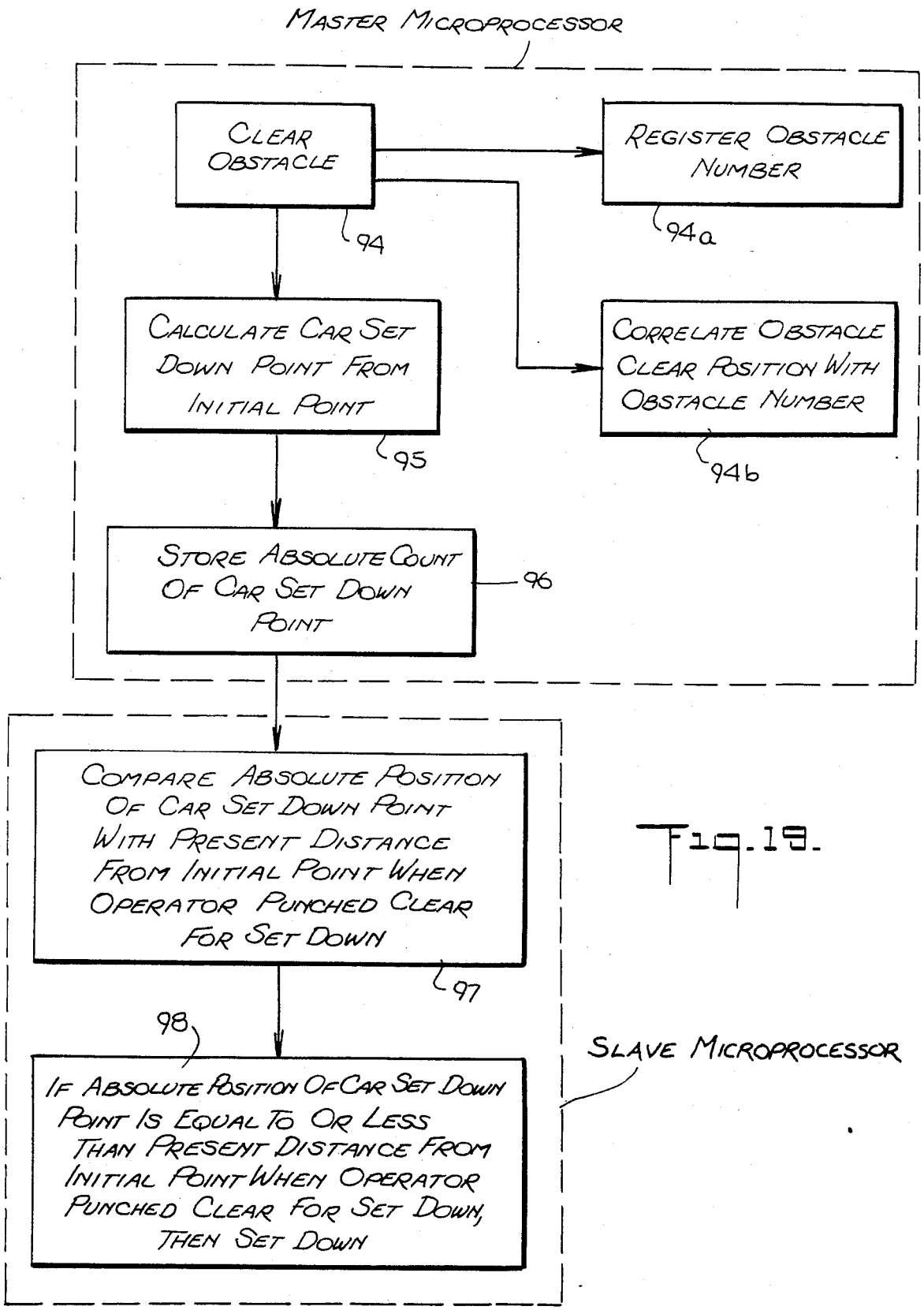
FIG. 19 is a flow chart of a portion of the master microprocessor and a portion of a slave microprocessor which operate according to a computer program produced by the flow chart of FIG. 19.

FIG. 19 is a flow chart for the grinding unit return to the rails or car set down point when the grinding units of the individual vehicles have cleared the obstacle. The operator in the leading locomotive visually sights the terminating end of the obstacle at a predetermined distance from the cab of the locomotive and enters the terminating end of the obstacle or obstacle clearance point in the clear obstacle portion 94 of the master microprocessor. The master microprocessor also contains a register obstacle number portion **94*a*. The master microprocessor also includes a correlate obstacle clear position with obstacle number portion 94***b*. The master microprocessor has a calculate car set down point from initial point when operator punched clear for set down (or enter clear obstacle) represented by portion 95. The master microprocessor also has a store absolute count of car set down point represented by portion 96.

The slave microprocessor has a compare absolute position of car set down point with present distance from initial point when operator punched clear for set down portion 97. The slave microprocessor also has a portion 98 which determines that if the absolute position of the car set down point is equal to or less than the present distance from the point when the operator punched clear for set down (or enter clear obstacle) then the grinding unit is set down at the set down point or within inches thereof.

Figure 15:
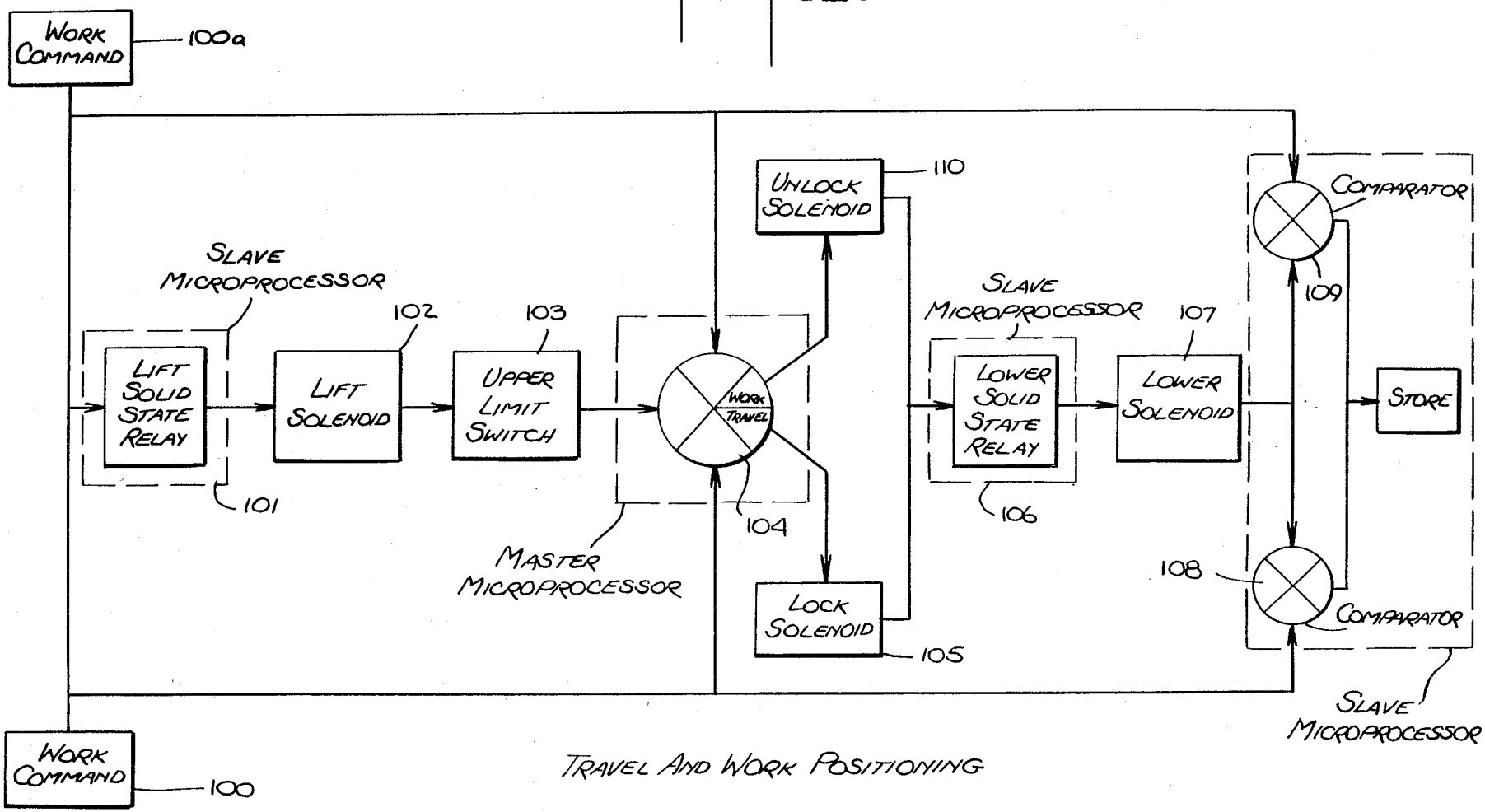
FIG. 15 is a schematic diagram of a portion of the railway track maintenance system for controlling the travel and work positioning of the buggies.

Referring now to FIG. 15, once the grinding has been completed for the work day, in order to travel at higher rates of speed along the track, the grinding buggies can be lifted into position and locked beneath the train. This is called the travel position. In order to enter the travel position the following sequence is accomplished by the operator's entering the travel command by a push button into a microprocessor portion indicated by block 100. First, all the grinders are put into the "no grind" position, which is the same as the obstacle clearance position, by using the obstacle clearance cylinders 31, 32 (FIG. 4). These cylinders are also used to lock and unlock the system into the travel position. Once they are put into the "no grind" position, the hooks 35, 36 (FIG. 4) are wide open and the raise or lift signal is given by the lift solid state relay 101 and the lift solenoid 102 to the hydraulic valve which causes the entire grinding buggy to be raised by the cables previously mentioned. The cylinder which raises the entire buggy by the cables operates until upper limit switches are hit, indicating that the grinding buggy is in the full raised position. This signal and the travel command signal are applied to a comparator 104 of the master microprocessor. At this time the lock solenoid 105 actuates the lower solid state relay 106 in the slave microprocessor and the lower solenoid 107, and the cylinders 31, 32 are de-actuated and the hooks 35, 36 or locks are moved to the lock position (FIG. 3) beneath the train. Comparator 108 in the slave microprocessor compares the travel command with the output signal of the lower solenoid 107. Then, once the limit switches have been hit, indicating the hooks 35, 36 or locks are fully engaged with supports under the train, the valve used to raise the entire buggy by cables is reversed, and the buggy is lowered so that it hangs by the hooks 35, 36. This lowering action is continued until the "down" limit switches have been hit to indicate that the buggy is hanging in the travel position. At this time, the system is shut down.

In order to go back into the work position, the reverse is accomplished by the operator's entering a work command by a push button into a microprocessor portion indicated by block 108*a*. First, the buggy is lifted until the upper limit switches are hit, then the solenoid valve 110 for unlocking the grinder buggy is energized, and the hooks 35, 36 or locks are opened. A comparator 109 in the slave microprocessor compares the work command with the output signal of the lower solenoid 107. The grinder is then lowered until the full down limit switch has been hit.

From the foregoing description, it will be appreciated that there preferably are four pairs of grinding motors on each buggy, with two pairs over the left rail and two pairs over the right rail. There preferably are three buggies per car or vehicle on a total of five grinding cars for a total of 120 grinding motors. Contoured head grinding and widely varying patterns are accomplished by 40°/0°/40° grinding wheel angles spread over 120 grinding heads with automatic angle control and pressure control on all motors. Accurate control of grinding allows precise metal removal of as little as 0.004 inch or as much as 0.050 inch covering a full spectrum of rail maintenance problems. There preferably are three combinations of angular position of grinding motors for each rail with a total radial (transverse to the rail) angular grinding motor travel of 90° for each grinding motor. The three combinations of angular position for each rail may, for example, be +45°, −45°; +70°, −20°; −70°, +20°, with the plus sign indicating a tilt toward the gauge or inside of the rail and a minus sign indicating a tilt toward the field or outside of the rail. The three combinations of angular position for each rail may also, for example, be +40°, 0°, and −40° as indicated above. Numerous individually selected combinations of positions and pressures of the grinding motors may be controlled by a program with each selected combination of all grinding wheel positions and pressures being called a pattern. An operator can also manually control the selection of individual grinding wheel angles and pressures through push button controls.

Figure 16B:
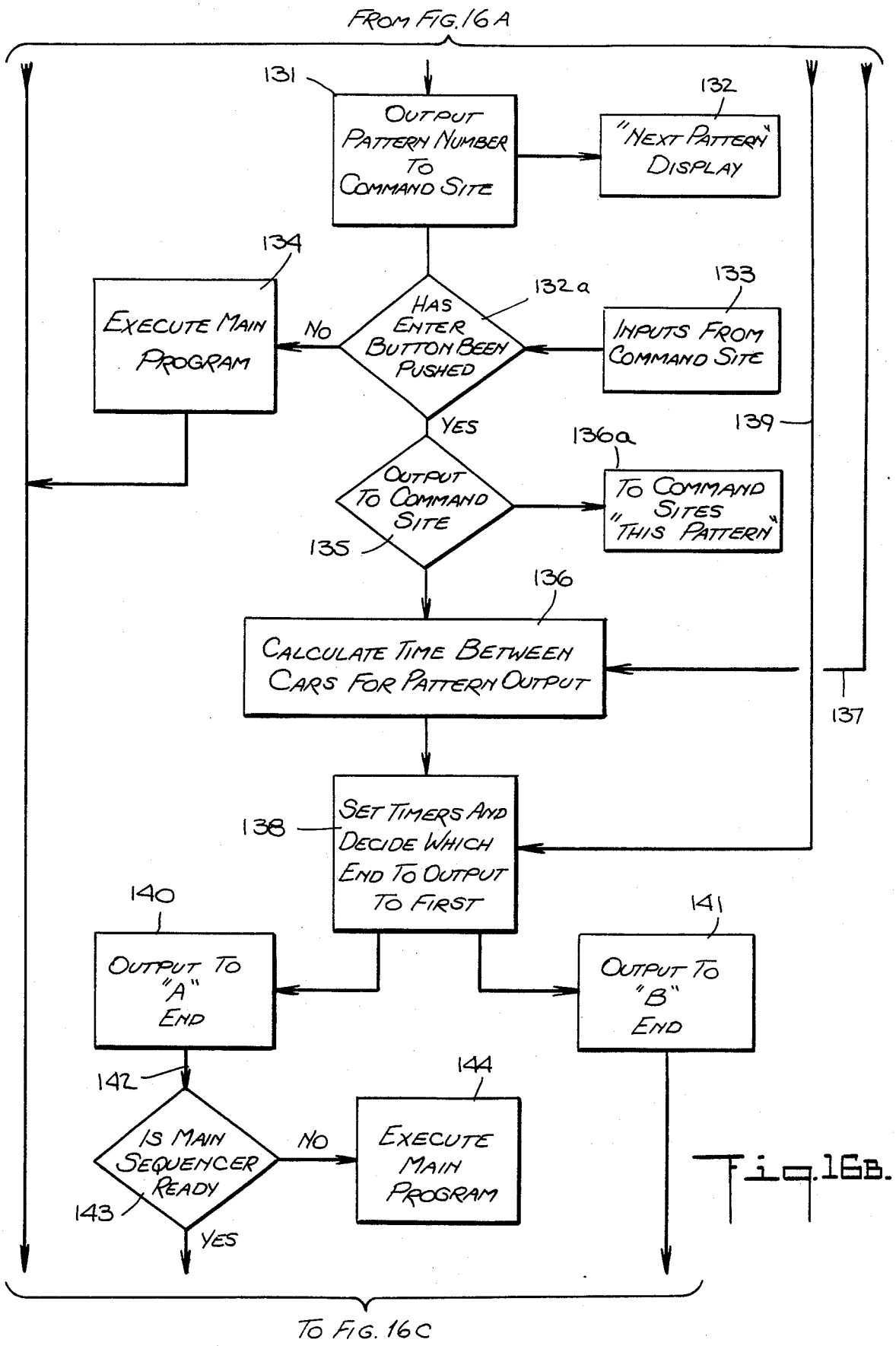
Figure 16C:
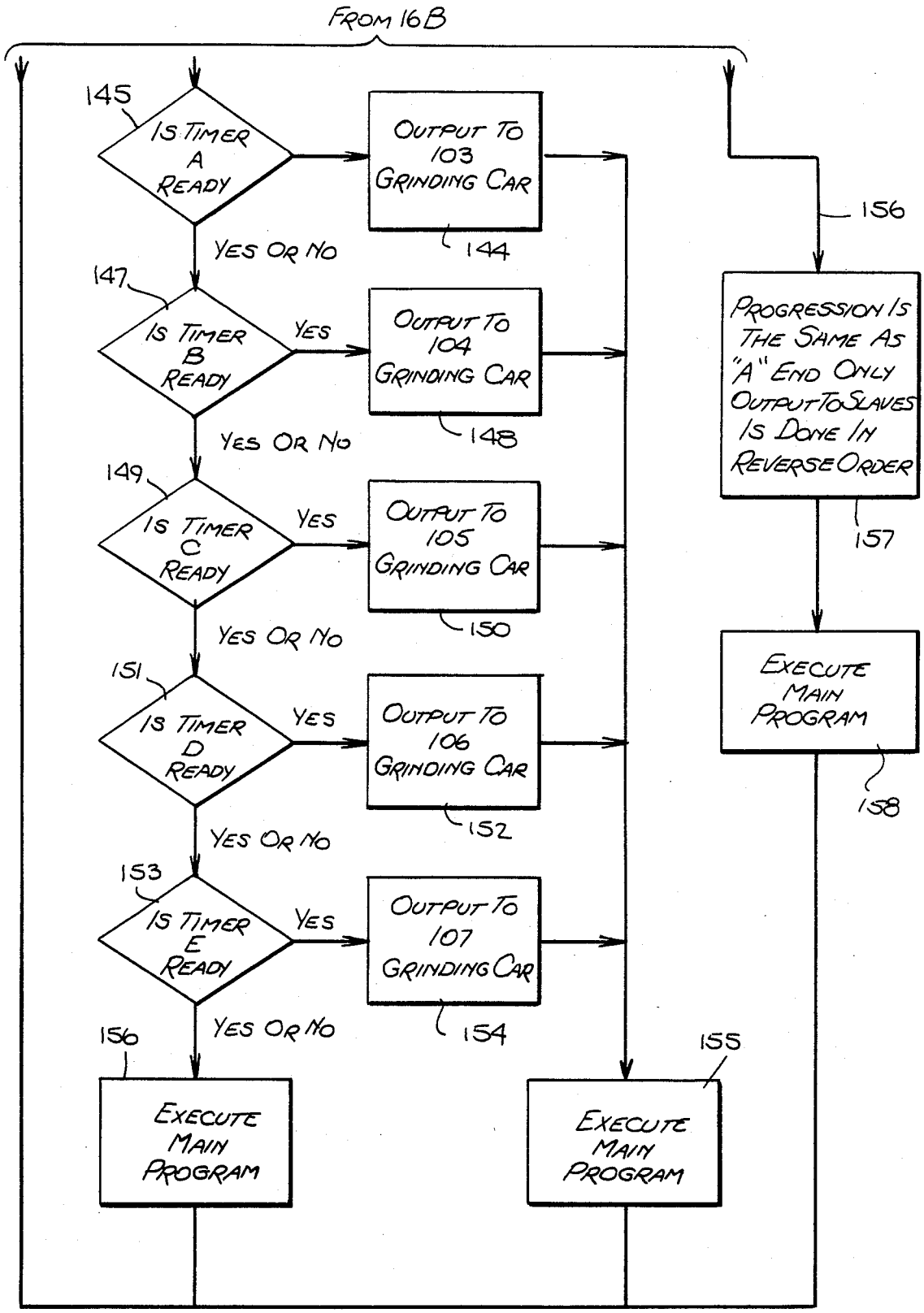

Referring now to FIG. 16 (illustrated in divided form as FIGS. 16A, 16B and 16C) there is represented a flow chart showing a sequential pattern change of the master microprocessor, which comprises a programmable controller, allowing the pattern to be changed for the entire 120 motors while the vehicles are moving at, for example, a grinding speed of two miles per hour, in a distance of approximately 45 feet which is less than the ordinary car length of 55 feet. While traveling at a grinding speed of four miles per hour, the entire pattern can be changed in approximately 90 feet. The pattern can be changed in about 15 seconds. The pattern is changed car by car as the vehicle or car moves past the desired point of pattern change. Thus, the distance between the old pattern and the new pattern along the rails can be reduced to less than a car length.

As represented in FIG. 16, by block 120, the power is turned on and applied to a portion of the microprocessor represented by system diagnostics block 121 which checks the operating condition of the components of the rail maintenance system. The program is then entered as indicated by the enter program block 122 and applied to the width command site A or B microprocessor portion represented by block 123. Command site A may be the operator's console in the leading locomotive and command site B may be the operator's console in the trailing locomotive. The input from either command site, normally the leading operator's command site, as represented by block 123*a*, is also applied to the microprocessor portion represented by block 123. Which command site is to be used is selected by tripping a switch at both command sites.

The microprocessor portion 123 applies a signal to a calculate and average speed and compare distance with internal clock microprocessor portion represented by block 124. A pulse generator 125 which develops output pulses representing the actual distance the vehicle has traveled since the enter program microprocessor portion 122 was actuated, applies the pulses representing distance to microprocessor portion 124. The microprocessor portion 124 is coupled to an output speed to slave microprocessor portion represented by block 126.

The microprocessor portion 124 is coupled to a determine direction of travel microprocessor portion 126*a* and an input from traction units or locomotives represented by block 127 is applied to microprocessor portion 126*a*.

Microprocessor portion 126*a* is coupled to a compute distance along track microprocessor porition 127*a*.

The microprocessor portion 127 computes the absolute distance along the track to the pattern set point or pattern change point from when the enter button (described subsequently) is pushed. The pulse generator 125 applies pulses representing distance travelled to the microprocessor portion 127*a*. The microprocessor portion 127*a* is coupled to a store distance information portion 128.

The microprocessor portion 127*a* is coupled to an is there any pattern input from command site microprocessor portion represented by block 128*a*. Inputs from command sites represented by block 129 are coupled to microprocessor portion 128*a*. If there has been no input from a command site, the microprocessor portion 128*a* is coupled to an execute main program microprocessor portion represented by block 130.

If there is an input from a command site the microprocessor portion 128*a* applies a signal to an output pattern number to command site microprocessor represented by block 131. Microprocessor portion 131 coupled to a next pattern display represented by block 132. The next pattern display is used as a buffer to hold a chosen pattern number before actually executing the pattern change. There are two next pattern displays, one located a each command site.

The microprocessor portion 131 is coupled to an has enter button been pushed microprocessor portion 132*a*. An inputs from command site portion represented by block 133 is coupled to the microprocessor portion 132*a*. The enter button is a button used by the operator to execute a pattern being held in the next pattern display 132. If the enter button has not been pushed, the microprocessor portion 132*a* applies a signal to execute main program portion represented by block 134. The main program refers to the code not associated with the operation being described. The portions 130 and 134 are coupled to enter program portion 122.

If the enter button has been pushed the microprocessor portion 132*a* applies a signal to an output to command sites microprocessor portion 135.

The microprocessor portion 135 applies an output signal to this pattern displays represented by block 136*a*. Each this pattern display displays the pattern number which is actually being executed. These displays are located adjacent to the next pattern displays.

The microprocessor portion 135 applies an output signal to a calculate time between cars for pattern output microprocessor portion represented by block 136. A microprocessor coupling portion 137 couples the calculate and average speed and compare distance with internal clock microprocessor portion 124 to microprocessor portion 136. Microprocessor portion 136 applies a signal to set timers and decide which end to output to first microprocessor portion represented by block 138. A microprocessor coupling portion 139 couples microprocessor portion 126*a* to microprocessor portion 138.

If command site A is in the leading locomotive, microprocessor portion 138 applies an output signal to output to A end microprocessor portion represented by block 140. If command site B in the leading locomotive, microprocessor portion 138 is coupled to the output to B end microprocessor portion represented by block 141. A microprocessor coupling portion 142 couples microprocessor portion 140 to its main sequencer ready microprocessor portion represented by block 143. If the main sequencer is not ready, microprocessor portion 143 applies a signal to an execute main program microprocessor portion represented by block 144. As previously mentioned, the main program refers to the code not associated with the operation being described. If the main sequencer is ready, microprocessor portion 143 applies a signal to an is timer A ready microprocessor portion represented by block 145. If timer A is ready, microprocessor portion 144 is coupled to an output to 103 grinding car microprocessor portion represented by block 146. The 103 grinding car is the leading car of the series of vehicles and corresponds to car 12 of FIG. 1 when locomotive 10 is the leading locomotive. The designation 103 grinding car is an abbreviation for the slave microprocessor controlling the grinding means under the leading grinding car.

If timer A is ready, the microprocessor portion 145 also applies a signal to an is timer B ready microprocessor portion represented by block 147. If timer A is not ready, microprocessor portion 145 also applies the signal to microprocessor portion 147. The flow chart indicates similar operations for microprocessor portions 147, 148, 149, 150, 151, 152, 153 and 154. The designations 104 grinding car, 105 grinding car, 106 grinding car and 107 grinding car are abbreviations for the slave microprocessor portions controlling the grinding mans under the cars which consecutively follow the leading grinding car. In this manner the pattern for all the grinding units are sequentially controlled car by car.

It will be seen from the flow chart that microprocessor portions 146, 148, 150, 152 and 154 are coupled to an execute main program microprocessor portion 155, which is, in turn, coupled to a microprocessor portion 122. The microprocessor portion 153 is also coupled to an execute main program microprocessor portion 156, which is also coupled to microprocessor portion 122.

Referring again to FIG. 16, if the vehicles are traveling in the reverse direction, for example, with the leading locomotive being locomotive 11 of FIG. 1, the microprocessor portion 141 applies an output singal to the B end. The microprocessor portion 141 coupled through a coupling portion 156 to a progression is the same as A end only output to slaves is done in reverse order microprocessor portion 157. The microprocessor portion 157 is coupled to an execute main program microprocessor portion represented by block 158 which is coupled to enter program block 122. Execute main program portions 155 and 156 are also coupled to enter program microprocessor portion 122.

In accordance with the automated railway track maintenance system of the invention, railway tracks are resurfaced by a train riding slowly along the tracks at a speed of, for example, two to four miles per hour. The grinding operation is accomplished by grinders which are positioned around the periphery of the rail by hydraulic cylinders and which are caused to move against the rail by air over air cylinders. Both the angular position of the grinders and the grinding force are controlled by a closed loop system. In addition, the grinding force and the angular settings of each grinder are automatic in that the operator of the system can select the angle and grinding pressure for all, for example, 120 grinding motors through the use of preassigned codes. Each code specifies the grinding angle and grinding pressure of each grinder along the train. In addition, the operator at the center console can adjust the pressure and angle of each grinder independently.

As the grinding train moves along the tracks, it also has the capability of lifting grinders in sequence as it nears obstacles along the tracks. The initiating of the sequencing, as well as the reset of the sequencing, is accomplished by the operator of the train as he nears the obstacle. Once the obstacle is entered into memory it is remembered for a distance of, for example, one mile in either direction. In other words if the train has passed the obstacle it can turn around and go back in the opposite direction without having to reenter the obstacle. One computer acts as the master computer and is located at the center console in the middle grinding car. There is also a slave computer for each grinding car which controls the actual operation of the grinders and angle positioners.

Each pair of grinders is angularly positioned by two hydraulic cylinders. Fluid flow to the hydraulic cylinders is controlled by hydraulic valves located in the grinding cars. Each pair is controlled by two hydraulic valves. One hydraulic valve controls the slow movement of the cylinders both clockwise and counterclockwise and a second hydraulic valve, which is turned on in addition to the flow valve, controls high speed motion counterclockwise and clockwise. A 10 volt power supply and a potentiometer supply the feedback signal which determines the actual position of the grinder. A microprocessor control together with solid state relays act as the output interface to the 120 volt A.C. control valves. A 12 bit analog to digtial converter converts the zero to 10 volt signal from the potentiometer into a signal which is used to control the valves.

When the train is put into service, the operators of the train use a machinist's level to level the grinding stones at zero degrees. Once all of the grinding stones at one car are placed at the zero degree angle a switch is thrown which automatically tells the computer what the offset voltage is for each grinder motor. The computer uses this offset voltage in making all its angular moves.

As represented in FIG. 12, a feedback potentiometer 70 connected to the motor carriage feeds a signal representing the angular position of the grinding stone to a 12 bit analog to digital converter 71. Since the converter is a 12 bit analog to digital converter, a 10 volt signal would give an accuracy of one part in 204. Once tne calibrations are done, represented by the zero calibration software 72 in FIG. 12, depending upon the total angular travel which the grinder will make, a volts per degree ratio is determined and a zero referenced digital position signal is applied to a comparator 73. When the operator or the automatic program enters a desired angle represented by a digital position setting 74, which may be a repeater of a digital position setting in the master microprocessor, the angle is converted to volts and digitized into counts as represented by the digital position setting 74. The computer then turns on the high speed motion in the proper direction until the grinder is within 5 counts of the actual position. This is done by means of a solid state relay 75 and a fast clockwise-counterclockwise valve 76. Once the grinder has neared the actual position by 5 counts, that is, once the error is less than 5 counts, the high speed solenoid valve is switched off and the grinder continues to travel at the slow speed. This is accomplished by the solid state relay 77 and the slow/fast clockwise-counterclockwise valve 78. The grinder will continue to travel at slow speed until it has an error of less than 1 count. At this point the low speed solenoid valve turns off and the grinder is in position. This is a closed loop positioning system where the potentiometer provides an actual count and the program provides a desired count. Motion continues until the desired count equals the actual count and the system then shuts down. Actual speed of motion is determined by the flow controls on the hydraulic circuit. Each pair of grinders throughout the train is controlled in a similar way.

Figure 17A:
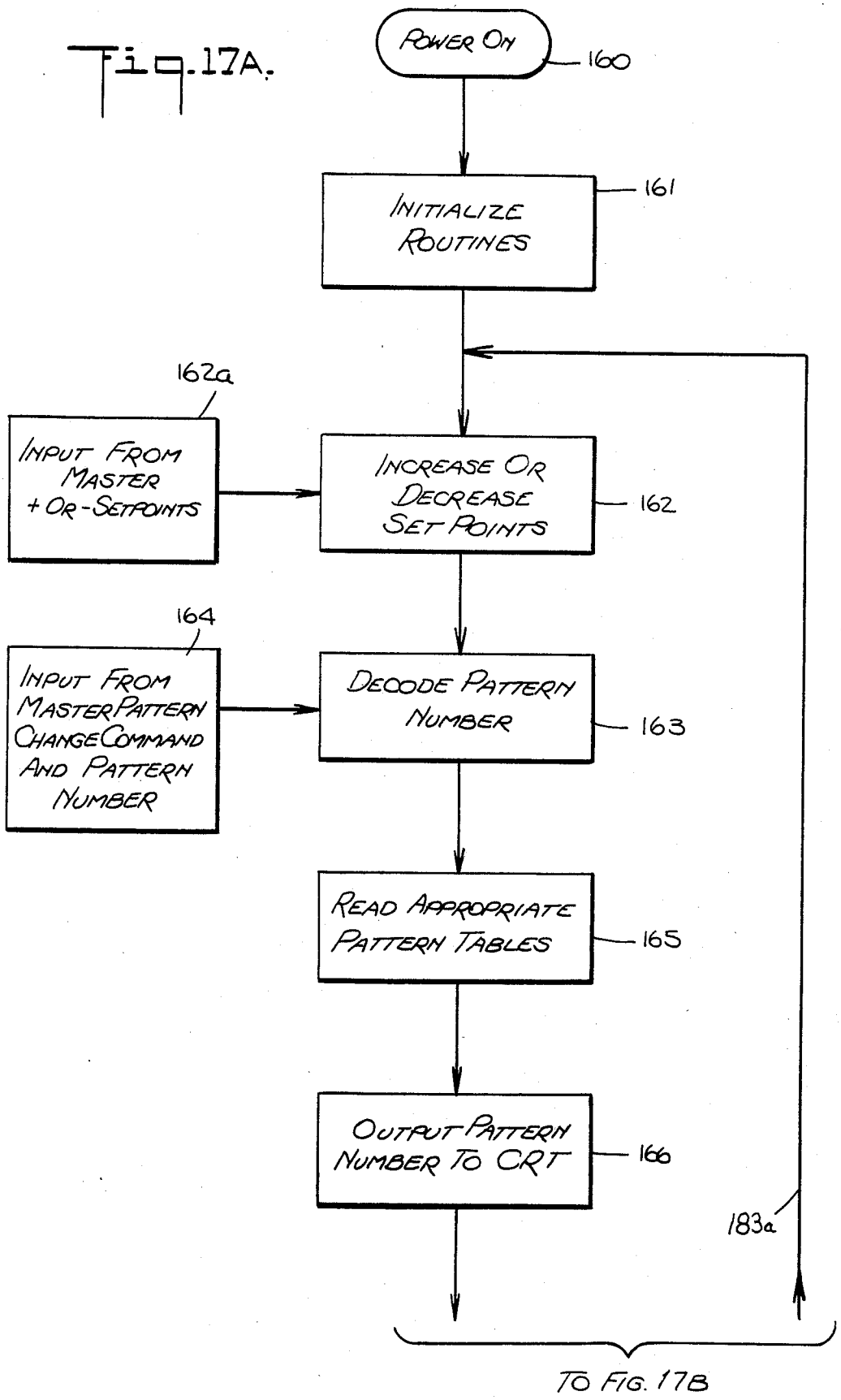
FIGS. 17A, 17B and 17C are a flow chart representing a portion of a slave microprocessor which operates according to a computer program produced according to the flow chart of FIG. 17.
Figure 17B:
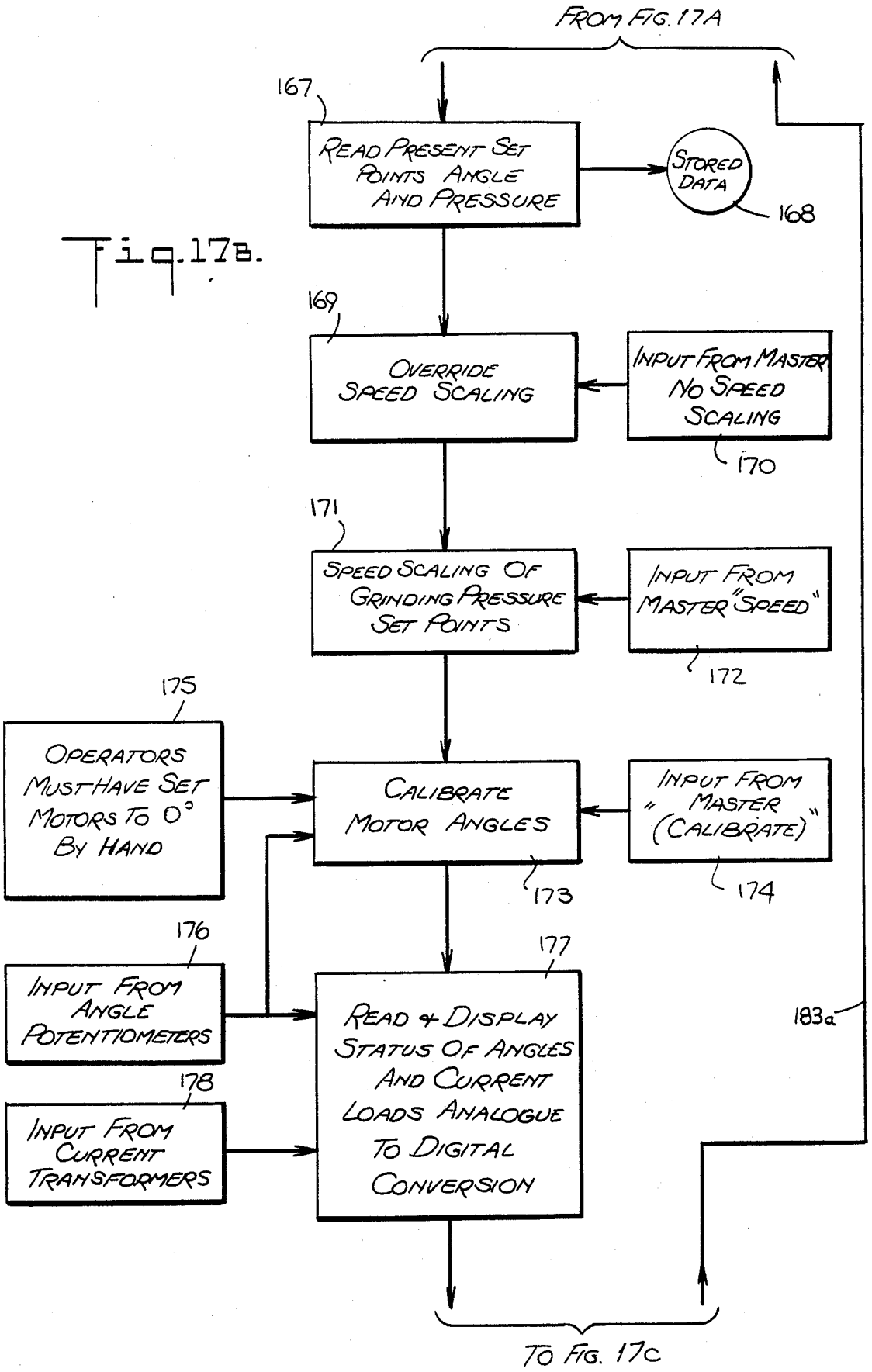
Figure 17C:
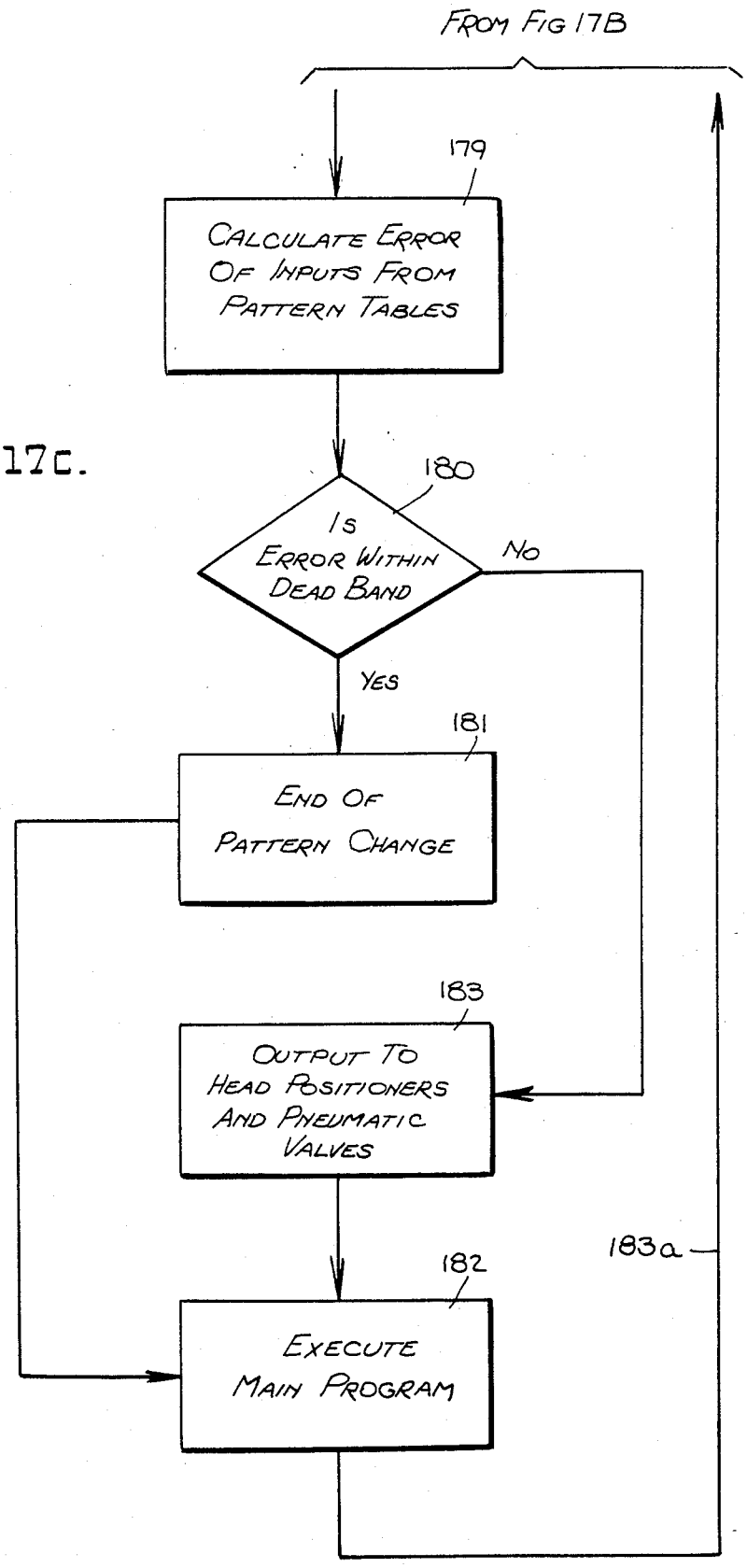

Referring now to FIG. 17 (illustrated in divided form as FIGS. 17A, 17B and 17C), there is represented a flow chart representing a portion of a slave microprocessor for executing a slave pattern change. Power is applied to the slave microprocessor as indicated by the power on microprocessor portion represented by block 160. An initialize routines microprocessor portion represented by block 161 is coupled to an increase or decrease set points microprocessor portion represented by block 162. An input from master plus or minus set points microprocessor portion represented by block **162*a* is coupled to microprocessor portion 162**. The set points are the values of position and current for the individual grinders retained in the memory and may be changed by an operator at the central console. These are read from tables in a non-volatile memory.

The microprocessor portion 162 is coupled to a decode pattern number microprocessor portion represented by block 163. An input from master pattern, change command and pattern number microprocessor portion represented by block 164 is also coupled to microprocessor portion 163. The microprocessor portion 163 is coupled to a read appropriate pattern tables microprocessor portion represented by block 165. The microprocessor portion 165 is coupled to an output pattern number to CRT microprocessor portion 166 which may be coupled to a cathode ray tube for displaying the pattern number. The microprocessor portion 166 is also coupled to a read present set points, angle and pressure microprocessor portion represented by block 167. A stored data microprocessor portion 168 is coupled to the microprocessor portion 167. Microprocessor portion 167 is coupled to an override speed scaling microprocessor portion 169. Speed scaling represents the capability of the slave microprocessor to adjust the grinding pressures to compensate for changes in speed, that is, more pressure is applied for higher vehicle speeds.

Most of the time the override speed scaling microprocessor portion 169 is operative to override speed scaling. An input from master microprocessor no speed scaling represented by block 170 is coupled to the override speed scaling portion microprocessor portion 169. Microprocessor portion 169 is coupled to speed scaling of grinding pressure set points microprocessor portion represented by block 171. An input from master speed microprocessor portion 172 is coupled to microprocessor portion 171. Microprocessor portion 172 is coupled to master microprocessor portion 126 of FIG. 16.

Microprocessor portion 171 is coupled to calibrate motor angles microprocessor portion represented by block 173. An input from master calibrate microprocessor portion represented by block 174 is coupled to microprocessor portion 173. Calibrate involves the operation of setting the grinding head positioners to a perpendicular to the rail and the storing by the programmable controller of this value and identifying it as zero degrees. The flow chart of FIG. 17 also includes an operators must have set motors to zero degrees by hand microprocessor portion represented by block 175 which is coupled to microprocessor portion 173.

An input from angle potentiometers microprocessor portion represented by block 176 is also coupled to microprocessor portion 173 and to a read and display status of angles and current loads and analog to digitial conversion microprocessor portion represented by block 177. An input from current transformers microprocessor portion represented by block 178 is also coupled to microprocessor portion 177.

Microprocessor portion 177 is coupled to a calculate error of inputs from pattern tables microprocessor portion represented by block 179. That is, the difference between the new pattern of inputs and the old pattern or existing pattern is calculated. Microprocessor portion 179 is coupled to an is error within dead band microprocessor portion represented by block 180. That is, the difference between the actual position of the grinding heads and the pressures of the grinding heads is determined as being within a predetermined tolerance from the new pattern or outside the tolerance from the new pattern. If the error is within the dead band microprocessor portion 180 is coupled to an end of pattern change microprocessor portion represented by block 181 which terminates the adjustment of the individual grinding heads so that they conform with the newly selected pattern. The end of pattern change microprocessor portion 181 is coupled to an execute main program microprocessor portion 182 which is coupled by a microprocessor portion represented by line 183*a* to the microprocessor portion 162.

If the error is not within the dead band microprocessor portion 180 is coupled to an output to grinding head positioners and pneumatic pressure regulation valves microprocessor portion represented by block 183. Microprocessor portion 183 controls the start stop operation of the grinding head motors and the angles of the motors and by means of controlling pneumatic pressure regulation valves controls the pressure on the grinding heads.

At the time the operator presses the enter button for entering a newly selected pattern, the pattern number is transferred to the master programmable controller. The master programmable controller in turn directs all the slave programmable controllers to interpret that number in terms of grinding pressures and grinding angles and operate the required valves in order to bring the motors into the required positions. The operator can continually update the next pattern number as he desires but nothing further will change until he again presses the enter button.

Pattern changes are executed on a car by car basis. When the lead console operator enters a new pattern, that pattern will be received by the first slave when it arrives at the point the operator was sighting when the button was pushed. Subsequent cars will do likewise. The train must be moving faster than one mile per hour for a sequenced pattern change to occur. If the train is stopped or travelling at less than one mile per hour, the pattern change is simultaneous at all cars. The train preferably should remain at constant speed throughout the pattern change. If not, individual cars will change pattern at locations different from the anticipated location. Once a pattern is entered, that pattern must be executed by all five grinding cars before a new pattern is entered.

A teach mode pattern designated 9,9 may be stored in non-volatile memory by setting all the set points to the desired settings and then entering a storage or store teach operation. All other pattern tables are entered with a video terminal. The pattern 9,9 will then be executed simultaneously by all cars.

As represented in FIG. 11A, ice flangers ahead of or behind the leading and trailing ends of the grinding vehicles can be individually raised and lowered under the control of the master microprocessor by program or by an operator.

Also in accordance with the invention, an automated railway track maintenance system for grinding the head of railway track rails comprises a plurality of rail head grinding means adapted for positioning under a plurality of railway vehicles. The system also includes a plurality of signal processor control means for controlling the grinding means in accordance with individually programmed commands and commands from an operator in a leading vehicle while the plurality of vehicles is moving.

From the foregoing description, it may be seen that the master signal processor control means can be effectively incorporated into the slave signal processor control means for controlling the grinding means under any of the vehicles. By making an individual incorporation of a portion of the master signal processor control means individually into the signal processor control means for individual vehicles, the master and slave relation can be eliminated and the signal processing control means for each can function independently. Such a system involves more complex and repetitive circuit means for each vehicle but it is considered to be within the scope of this invention.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An automated railway track maintenance system for grinding the head of railway track rails, comprising:

rail head grinding means adapted for positioning under at least one railway vehicle;

means for raising said grinding means;

master signal processor control means at least partially adapted for actuation by an operator in the leading vehicle of a series of railway vehicles for controlling said grinding means; and slave signal processor control means responsive to said master signal processor control means for controlling said grinding means in accordance with commands from said master signal processor control means;

said master signal processor control means including means for storing an absolute count representative of the distance between an obstacle whose position is located by an operator in the leading vehicle and the position of at least one of said series of vehicles when the operator actuates said master signal processor control means, means for calculating the distance along the rails between the position along the rails for actuating, by said master and slave signal processor control means, said means for raising said grinding means and said position of said at least one vehicle, and means for comparing said absolute count with the distance between the obstacle and the position of said at least one vehicle when said at least one vehicle has advanced toward the obstacle and while said vehicle is moving at a grinding speed.

2. A system in accordance with claim 1, in which said rail head grinding means includes a plurality of said grinding means adapted for positioning under a plurality of railway vehicles, in which said slave signal processor control means includes a plurality of slave signal processor control means individually responsive to said master signal processor control means for individually controlling said plurality of grinding means, in which said means for raising said grinding means includes a plurality of means for raising said grinding means, and in which said master signal processor control means includes means for storing an absolute count representative of the distance between an obstacle whose position is located by an operator in the leading vehicle and the position of at least one of said series of vehicle when the operator actuates said master signal processor control means, means for calculating the distance along the rails between the position along the rails for actuating individually, by said master and slave signal processor control means, said plurality of means for raising individually said plurality of said grinding means at approximately the same position along the rails, and means for comparing said absolute count with the distance between the obstacle and the position of said at least one vehicle when said vehicle has advanced toward the obstacle and while said vehicle is moving at a grinding speed.

3. A system in accordance with claim 1, in which said master signal processor control means is at least partially adapted for actuation by an operator in the trailing vehicle of a series of railway vehicles operable in reverse directions.

4. A system in accordance with claim 1, in which said master signal processor control means includes means for calculating the average speed of the series of railway vehicles, means for calculating a representation of the distance of said grinding means from a selected point along said railway rails, means for storing a plurality of pattern codes representing the desired settings of said grinding means, and means for selecting a pattern code for translating a command signal in accordance therewith to said slave signal processor control means.

5. A system in accordance with claim 2, in which said master signal processor control means includes means for calculating the average speed of the series of railway vehicles, means for calculating a representition of the distance of said grinding means from a selected point along said railway rails, means for storing a plurality of pattern codes representing the desired settings of said grinding means, and means for selecting a pattern code for translating a command signal in accordance therewith to said plurality of slave signal processor control means.

6. A system in accordance with claim 4, in which said master signal processor control means can be selectively actuated by an operator in the leading vehicle to change from one pattern code to another while the series of vehicles is moving at a grinding speed.

7. A system in accordance with claim 5, in which said master signal processor control means can be selectively actuated by an operator in the leading vehicle to change from one pattern code to another for each of said plurality of slave signal processor control means, and in which each of said plurality of slave signal processor control means responds to the newly selected code at a position along the railway rails within a distance less than the length of two of said series of vehicles while said series of vehicles is moving at a grinding speed.

8. A system in accordance with claim 7, in which said last-mentioned distance is less than the length of a single vehicle of said series of vehicles.

9. A system in accordance with claim 1 in which means are provided for lowering said grinding means, and in which said master signal processor control means includes means for storing an absolute count representative of the distance between an obstacle terminating end whose position is located by an operator in the leading vehicle and the position of at least one of said series of vehicles when the operator actuates said master signal processor control means, means for calculating the distance along the rails between the position along the rails for actuating, by said master and slave signal processor control means, said means for lowering said grinding means and said position of said at least one vehicle, and means for comparing said absolute count with the distance between the obstacle terminating end and the position of said at least one vehicle when said vehicle has advanced toward the obstacle terminating end and while said vehicle is moving at a grinding speed.

10. A system in accordance with claim 2, in which a plurality of means are provided for lowering said grinding means, and in which said master signal processor control means includes means for storing an absolute count representative of the distance between an obstacle terminating end whose position is located by an operator in the leading vehicle and the position of at least one of said series of vehicles when the operator actuates said master signal processor control means, means for calculating the distance along the rails between the position along the rails for actuating individually, by said master and slave signal processor control means, said plurality of said means for lowering individually said plurality of said grinding means at approximately the same position along the rails, and means for comparing said absolute end count with the distance between the obstacle terminating end and the position of said at least one vehicle when said vehicle has advanced toward the obstacle terminating end and while said vehicle is moving at a grinding speed.

11. A system in accordance with claim 2, in which said comparing means includes means for calculating the distance between the obstacle and individual ones of said plurality of railway vehicles to enable said plurality of means for raising said grinding means to raise said grinding means for individual vehicles sequentially at approximately the same position along the railway rails while said series of vehicles is moving at a grinding speed.

12. A system in accordance with claim 10, in which said comparing means includes means for calculating the distance between the obstacle terminating end and individual ones of said plurality of railway vehicles to enable said plurality of means for lowering said grinding means to lower said grinding means for individual vehicles sequentially at approximately the same position along the railway rails while said series of vehicles is moving at a grinding speed.

13. A system in accordance with claim 6, in which said rail head grinding means includes plurality of said grinding means adapted for positioning under a plurality of railway vehicles, and in which said slave signal processor control means includes a plurality of slave signal processor control means responsive to said master signal processor control means for individually controlling said plurality of grinding means.

14. An automated railway track maintenance system for grinding the head of railway track rails, comprising:

a plurality of rail head grinding means adapted for positioning under a plurality of railway vehicles;

means for raising said grinding means; and a plurality of signal processor control means for controlling said grinding means in accordance with individually programmed commands and commands from an operator in a leading vehicle while said plurality of vehicles is moving;

said signal processor control means including means for storing an absolute count representative of the distance between an obstacle whose position is located by an operator in the leading vehicle and the position of at least one of said series of vehicles when the operator actuates said signal processor control means, means for calculating the distance along the rails between the position along the rails for actuating, by said signal processor control means, said means for raising said grinding means and said position of said at least one vehicle, and means for comparing said absolute count with the distance between the obstacle and the position of said at least one vehicle when said vehicle has advanced toward the obstacle and while said vehicle is moving at a grinding speed.

15. A system in accordance with claim 14, in which said signal processor control means includes means for calculating the average speed of the series of railway vehicles, means for calculating a representation of the distance of said grinding means from a selected point along said railway rails, means for storing a plurality of pattern codes representing the desired settings of said grinding means, and means for selecting a pattern code.

16. A system in accordance with claim 14, in which said signal processor control means can be selectively actuated by an operator in the leading vehicle to change from one pattern code to another while the series of vehicles is moving at a grinding speed.

17. A system in accordance with claim 14, in which said signal processor control means can be selectively actuated by an operator in the leading vehicle to change from one pattern code to another for each of said plurality of signal processor control means, and in which each of said plurality of signal processor control means responds to the newly selected code at a position along the railway rails within a distance less than the length of two of said series of vehicles while said series of vehicles is moving at a grinding speed.

18. A system in accordance with claim 17, in which said distance is less than the length of a single vehicle of said series of vehicles.

19. A system in accordance with 14, in which a plurality of means are provided for raising said grinding means, and in which said signal processor control means includes means for storing an absolute count representative of the distance between an obstacle whose position is located by an operator in the leading vehicle and the position of at least one of said series of vehicles when the operator actuates said signal processor control means, means for calculating the distance along the rails between the position along the rails for actuating individually, by said signal processor control means, said plurality of said means for raising individually said plurality of said grinding means at approximately the same position along the rails, and means for comparing said absolute count with the distance between the obstacle and the position of said at least one vehicle when said vehicle has advanced toward the obstacle and while said vehicle is moving at a grinding speed.

20. A system in accordance with claim 14, in which means are provided for lowering said grinding means, and in which said signal processor control means includes means for storing an absolute count representative of the distance between an obstacle terminating end whose position is located by an operator in the leading vehicle and the position of at least one of said series of vehicles when the operator actuates said signal processor control means, means for calculating the distance along the rails between the position along the rails for actuating, by said signal processor control means, said means for lowering said grinding means and said position of said at least one vehicle, and means for comparing said absolute count with the distance between the obstacle terminating end and the position of said at least one vehicle, and means for comparing said absolute count with the distance between the obstacle terminating end and the position of said at least one vehicle when said vehicle has advanced toward the obstacle terminating end and while said vehicle is moving at a grinding speed.

21. A system in accordance with claim 14, in which a plurality of means are provided for lowering said grinding means, and in which said signal processor control means controls means for storing an absolute count representative of the distance between the obstacle terminating end whose position is located by an operator in the leading vehicle and the position of at least one of said series of vehicles when the operator actuates said signal processor control means, means for calculating the distance along the rails for actuating individually, by said signal processor control means, said plurality of said means for lowering individually said plurality of said grinding means at approximately the same position along the rails, and means for comparing said absolute count with the distance between the obstacle terminating end and the position of said at least one vehicle when said vehicle has advanced toward the obstacle terminating end and while said vehicle is moving at a grinding speed.

22. A system in accordance with claim 19, in which said comparing means includes means for calculating the distance between the obstacle and individual ones of said plurality of railway vehicles to enable said plurality of means for raising said grinding means to raise said grinding means for individual vehicles sequentially at approximately the same position along the railway rails while said series of vehicles is moving at a grinding speed.

23. A system in accordance with claim 21, in which said comparing means includes means for calculating the distance between the obstacle terminating end and individual ones of said plurality of railway vehicles to enable said plurality of means for lowering said grinding means to lower said grinding means for individual vehicles sequentially at approximately the same position along the railway rails while said series of vehicles is moving at a grinding speed.

24. An automated railway track maintenance system for grinding the head of a railway track rail, comprising:

rail head grinding means adapted for location under at least one railway vehicle movable along the track, said rail head grinding means being further adapted, when located under said at least one vehicle, for arrangement in any of a plurality of patterns of position relative to said at least one vehicle; and programmable computer means for controlling the patterns of position of said grinding means independently of the configuration of the rail head, said programmable computer means including memory means for storing said plurality of patterns and microprocessor means for selecting any desired one of said patterns and for controlling the respective position of said grinding means.

25. A system in accordance with claim 24, in which switch means associated with said programmable computer means are provided, said switch means being operable by an operator for activating said microprocessor means to select a desired pattern of position of said grinding means.

26. A system in accordance with claim 24, in which a plurality of individual grinders constituting said grinding means are provided, said grinders being disposed in a predetermined arrangement relative to said at least one vehicle, and said programmable computer means being operable to control the individual patterns of position of all said grinders, and in which said microprocessor means, for purposes of executing, at a preselected location of said at least one vehicle along a rail, a change in an existing pattern of position of any of said grinders while said at least one vehicle is in motion along the rail and said grinders are in respective stages of operation, includes means for effecting said pattern change as the respective grinder reaches said preselected location.

27. A system in accordance with claim 24, for grinding the heads of both rails of a railway track concurrently, in which are provided two sets of grinding means, one for each rail, in association with said at least one vehicle, and in which said microprocessor means is operable for selecting a respective pattern of position for each of said sets of grinding means.

28. A system in accordance with claim 27, in which switch means associated with said programmable computer means are provided, said switch means being operable by an operator for activating said microprocessor means to select a desired pattern of position for each of said sets of grinding means.

29. A system in accordance with claim 27, in which a respective plurality of individual grinders constituting each of said sets of grinding means are provided, each plurality of grinders being disposed in a respective predetermined arrangement relative to said at least one vehicle, in which said programmable computer means is operable to control the individual patterns of position of all said grinders, and in which said microprocessor means, for purposes of executing, at a preselected location of said at least one vehicle along a rail, a change in an existing pattern of position of any of said grinders of either set of grinding means while said at least one vehicle is in motion along the rails and said grinders are in respective stages of operation, includes means for effecting said pattern change as each respective grinder reaches said preselected location.

30. A system in accordance with claim 24, which includes means for raising said grinding means, and in which said memory means includes means for storing an absolute count representative of the distance between an obstacle whose position is located by an operator in the leading vehicle of a vehicle train including said at least one vehicle and the position of said at least one vehicle when the operator actuates said programmable computer means, means for calculating the distance along the rails between the position along the rails for actuating, by said programmable computer means, said means for raising said grinding means and said position of said at least one vehicle, and means for comparing said position of said at least one vehicle when the latter has advanced twoard the obstacle and while said at least one vehicle is moving at a grinding speed.

31. A system in accordance with claim 24, which includes a plurality of grinding means and a plurality of means for raising said grinding means, respectively, and in which said memory means includes means for storing an absolute count representative of the distance between an obstacle whose position is located by an operator in the leading vehicle and of a vehicle train including said at least one vehicle and the position of said at least one vehicle when the operator actuates said programmable computer means, means for calculating the distance along the rails between the position along the rails for actuating individually, by said programmable computer means, said plurality of said means for raising individually said plurality of said grinding means at approximately the same position along the rails, and means for comparing said absolute count with the distance between the obstacle and the position of said at least one vehicle when the latter has advanced toward the obstacle and while said at least one vehicle is moving at a grinding speed.

32. A system in accordance with claim 24, which includes means for lowering said grinding means, and in which said memory means includes means for storing an absolute count representative of the distance between an obstacle terminating end whose position is located by an operator in the leading vehicle of a vehicle train including said at least one vehicle and the position of said at least one vehicle when the operator actuates said programmable computer means, means for calculating the distance along the rails between the position along the rails for actuating, by said programmable computer means, said means for lowering said grinding means and said position of said at least one vehicle, and means for comparing said absolute count with the distance between the obstacle terminating end and the position of said at least one vehicle when the latter has advanced said grinding means past the obstacle terminating end and while said at least one vehicle is moving at a grinding speed.

33. A system in accordance with claim 24, which includes a plurality of grinding means and a plurality of means for lowering said grinding means, respectively, and in which said memory means includes means for storing an absolute count representative of the distance between an obstacle terminating end whose position is located by an operator in the leading vehicle of a vehicle train including said at least one vehicle and the position of said at least one vehicle when the operator actuates said programmable computer means, means for calculating the distance along the rails between the position along the rails for actuating individually, by said programmable computer means, said plurality of said means for lowering individually said plurality of said grinding means at approximately the same position along the rails, and means for comparing said absolute end count with the distance between the obstacle terminating end and the position of said at least one vehicle when the latter has advanced a respective grinding means past the obstacle terminating end and while said at least one vehicle is moving at a grinding speed.

34. A system in accordance with claim 31, in which said comparing means includes means for calculating the distance between the obstacle and individual ones of the vehicles of said vehicle train to enable said plurality of means for raising said grinding means to raise said grinding means for individual vehicles sequentially at approximately the same position along the the railway rails while said vehicles are moving at a grinding speed.

35. A system in accordance with claim 33, in which said comparing means includes means for calculating the distance between the obstacle terminating end and individual ones of the vehicles of said vehicle train to enable said plurality of means for lowering said grinding means to lower said grinding means for individual vehicles sequentially at approximately the same position along the railway rails while said vehicles are moving at a grinding speed.

* * * * *

UNITED STATES PATENT AND TRADEMARK OFFICE

CERTIFICATE OF CORRECTION

PATENT NO. : 4,584,798

DATED : April 29, 1986

INVENTOR(S) : Albert Rivoire

It is certified that error appears in the above-identified patent and that said Letters Patent is hereby corrected as shown below:

Column 1, line 44, delete "in"; line 63, for "parially" read --partially--. Column 2, line 33, after "plan" read --view--; line 38, after "grinding" read --units--. Column 3, line 65, before "mounted" read --is--; line 66, for "actuating" read --actuates--. Column 6, line 5, for "capabidty" read --capability--; line 49, after "calibrations" read --are--. Column 7, line 3, for "low" read --slow--. Column 11, line 11, for "porition" read --portion--; line 32, after "131" (second occurrence) read --is--. Column 12, line 8, for "its" read --is--. Column 17, line 26, for "vehicle" read --vehicles--; line 58, for "representition" read --representation--. Column 22 line 18, for "twoard" read --toward--; line 26, delete "and". Column 17, line 34; column 18, line 49; column 20, line 10 and line 49; column 22, line 34; and column 23, line 6; in each case, after "rails" read --and said position of said at least one vehicle--.

Signed and Sealed this

Eleventh Day of November, 1986

*Attest:*

DONALD J. QUIGG

*Attesting Officer* *Commissioner of Patents and Trademarks*